US010828233B2

(12) United States Patent
Jamieson

(10) Patent No.: US 10,828,233 B2
(45) Date of Patent: Nov. 10, 2020

(54) TARGETED MYOFASIAL RELEASE THROUGH USE OF A ROLLING TRACK

(71) Applicant: Wellness Integration Tools Co., San Francisco, CA (US)

(72) Inventor: Kristin Jamieson, San Francisco, CA (US)

(73) Assignee: Wellness Integration Tools Co.

( * ) Notice: Subject to any disclaimer, the term of this patent is extended or adjusted under 35 U.S.C. 154(b) by 520 days.

(21) Appl. No.: 15/782,842

(22) Filed: Oct. 12, 2017

(65) Prior Publication Data

US 2018/0104143 A1 Apr. 19, 2018

Related U.S. Application Data

(60) Provisional application No. 62/408,647, filed on Oct. 14, 2016.

(51) Int. Cl.

| | |
|---|---|
| ***A61H 37/00*** | (2006.01) |
| ***A61H 7/00*** | (2006.01) |
| ***A61H 15/00*** | (2006.01) |

(52) U.S. Cl.

CPC ..... *A61H 37/00* (2013.01); *A61H 7/002* (2013.01); *A61H 7/007* (2013.01);

(Continued)

(58) Field of Classification Search

CPC ..... A61H 15/00; A61H 2015/0007; A61H 2015/0042; A61H 2015/0064; A61H 37/00; A61H 2201/0123; A61H 2201/0126; A61H 15/0092; A61H 7/00; A61H 7/002; A61H 7/007; A61H 2201/00; A61H 2201/01; A61H 2201/0119; A61H 2201/0192; A61H 2201/16; A61H 2201/169; A61H 2201/1695; A61H 2203/00;

(Continued)

(56) References Cited

U.S. PATENT DOCUMENTS

2011/0105968 A1* 5/2011 Angell ..... A61H 15/00 601/132
2015/0025568 A1* 1/2015 Liu ..... A61H 39/04 606/204

(Continued)

FOREIGN PATENT DOCUMENTS

DE 102009022319 A1 * 11/2010 ..... A61H 15/00

*Primary Examiner* — Kendra D Carter
*Assistant Examiner* — Eric Theisen
(74) *Attorney, Agent, or Firm* — Jensen-Haxel Law

(57) ABSTRACT

Disclosed are an apparatus, a method, and/or a system of targeted myofascial release through use of a rolling track. In one or more embodiments, an apparatus for targeted myofascial release of a human body, muscles, and fascia includes a rolling track with one or more supports forming a support contour permitting a ball to roll along the rolling track while the body exerts force against the ball. The support contour transitions into a rolling surface so the ball can be guided out of the rolling track to the rolling surface and then guided back in. A friction means such as a lip and/or friction surface retains the ball in the rolling track. The rolling track is securable relative to the rolling surface via a mount. The adjustment track may have two or more adjustment positions for repositioning along the rolling surface and/or a pivot to adjust a track orientation.

20 Claims, 17 Drawing Sheets

(52) U.S. Cl.
CPC ..... *A61H 2015/0042* (2013.01); *A61H 2015/0064* (2013.01); *A61H 2201/0103* (2013.01); *A61H 2201/0119* (2013.01); *A61H 2201/0126* (2013.01); *A61H 2201/0192* (2013.01); *A61H 2201/1695* (2013.01)

(58) Field of Classification Search
CPC ..... A61H 2203/04; A61H 2203/0406; A61H 2205/00; A61H 2205/04; A61H 2205/06; A61H 2205/062; A61H 2205/08; A61H 2205/081; A61H 39/00; A61H 39/04
See application file for complete search history.

(56) References Cited

U.S. PATENT DOCUMENTS

| | | | | |
|---|---|---|---|---|
| 2015/0224016 | A1* | 8/2015 | Holland | A61H 15/00 601/131 |
| 2015/0257962 | A1* | 9/2015 | Shannon | A61H 15/00 601/98 |
| 2018/0028397 | A1* | 2/2018 | Underwood | A61H 1/005 |

* cited by examiner

TARGETED RELEASE PROCESS FLOW 1450

FIG. 15 DOWN-PRESSURE TARGETED RELEASE PROCESS FLOW 1550

TARGETED MYOFASIAL RELEASE THROUGH USE OF A ROLLING TRACK

CROSS-REFERENCE TO RELATED APPLICATIONS

This application claims the benefit of U.S. Provisional Application No. 62/408,647, filed Oct. 14, 2016, entitled: WALL OR VERTICAL SURFACE MOUNTED SELF-MASSAGE TOOL. The patent application identified above is incorporated here by reference in its entirety to provide continuity of disclosure.

FIELD OF TECHNOLOGY

This disclosure relates generally to physical therapy, and more particularly to an apparatus, a method, and/or a system of targeted myofascial release through use of a rolling track.

BACKGROUND

Muscle pain and tightness may be a common experience of the human body. It can arise for a variety of reasons, and may encountered by both athletes who frequently exert muscles to everyday workers who may hold low-level muscle tension for long periods while using tools such as computers and smartphones.

One source of pain may be two distinct but related phenomenon of muscle and its surrounding connective tissue. A first phenomenon derives from the fascia. The fascia may be a web-like connective tissue, which may be primarily collagen, located beneath the skin. The fascia may attach, stabilize, enclose, and/or separate muscles and other internal organs. The fascia also may bindle individual muscle fibers or cells to import shape to muscle tissue. The fascia is generally a robust material, capable of enduring high stress and strain. However, during muscle use, knots or tangles in the connective tissue can form as the fascia adheres to itself. Over time these tangles may increase, and may cause restriction in muscles sometimes referred to as a tension point and/or a trigger point.

Similarly, muscles fibers may be comprised of numerous sarcomeres, which may be the basic unit of striated muscle tissue. Each sarcomere is able to expand and contract, and groups work together to cause the overall muscle to expand and contract. However, groups of sarcomeres may sometimes fail to release after contracting, which may also result in a tension point.

While fascia knots and sarcomere knots may exist independently, fascia knots may result from nearby sarcomere knots and vice versa. In either case, the tension points can lead to tightness of the muscle, pain (including extreme or chronic pain), and limited range of motion. "Referred pain" distant to the trigger point can also result, or the tension points may have ancillary affects such as headache. Tension points may also prevent oxygen and nutrients from reaching muscle cells, causing the release of inflammation causing molecules.

The tension points may have a variety of causes. Trauma, general inflammatory responses, and/or surgical procedures induce knots in the fascia. Tension points may commonly arise in the muscles of athletes who routinely exert and push the muscles to grow in strength. Static holding of tissue and prolonged low load tension (as is created with a forward head and slumped postures) may increase adhesions in fascial tissue.

However, some muscles of the human body may seem to experience tension points with increased frequency. For example, tension points may occur in the muscles of the upper shoulders and neck, including the upper trapezius, levator scapulae, and supraspinatus muscles. One cause for this increased frequency may be the use of technology devices. For example, pain from the use of smartphone, tablet, and laptop computers has been referred to as "tech-neck". People may tend to "hold" these muscles throughout the day (during activities such as typing, texting, sitting, lifting, driving, etc.) in an elevated direction, resulting in the static muscle position that may lead to fascia adhesion.

Myofascial release is a general method that may be known to unwind the knots associated with tension points. In general, manual pressure is applied to the tension point at a number of angle and pressure variances on relaxed muscles, for example by way of a massage by another person. While professional message is one method that may be commonly practice, it is not always readily available for a person. As a result, a number of methods of self-message have been developed for myofascial release, for example applying force with a body part against a ball, or rolling on foam cylinders.

However, self-massage presents some challenges. It may be difficult to generate an ideal direction of force into muscles and surrounding connective tissue. It may be difficult to hunt for and find tension points. It may also be difficult to generate pressure for the neck, shoulders, and upper back where many tension points may have developed, including downward pressure. Some methods may require getting down on the floor which may for some be difficult or inconvenient. Methods for addressing tension points in the back, neck, and shoulders may require use of the arms. This may decrease the effectiveness of myofascial release pressure by engaging the proximate arm muscles. As a result, muscles and myofascial connective tissue may continue to be wrought with tension points, causing the human body inflammation, limited mobility, and pain.

SUMMARY

Disclosed is an apparatus, a method, and/or a system of targeted myofascial release through use of a rolling track.

In one embodiment, an apparatus for targeted myofascial release of a human body includes a rolling track that includes one or more supports forming a support contour. The one or more supports permit a ball to roll along the rolling track while the human body exerts force against the ball toward the support contour, with the rolling track open along an edge such that the human body can contact the ball. The support contour transitions into a rolling surface such that while continuous force is exerted against the ball the human body can guide the ball out of the rolling track to the rolling surface substantially unimpeded at a first location along the rolling track and rejoin the rolling track from the rolling surface substantially unimpeded at a second location along the rolling track.

The rolling track further includes a friction means of the rolling track that retains the ball in the rolling track when a force that is both parallel to the rolling surface and toward the support contour is exerted on the ball by the human body. The rolling track also includes a mount for securing the rolling track relative to the rolling surface such that the rolling track is immobile relative to the rolling surface when the force is exerted by the human body against the ball toward the support contour.

The friction means may be a lip that retains the ball in the rolling track when the force that is both parallel to the rolling surface and toward the support contour is exerted on the ball by the human body. An adjustment track may be connected to the rolling track to provide two or more adjustment positions such that the rolling track repositionable along the rolling surface. The friction means may retain the ball between 2 inches in diameter and 4 inches in diameter in the rolling track while the force exerted by the human body toward the support contour is parallel to the rolling surface.

At a cross-section of the rolling track, an intersection of a first line normal to a first point on the support contour and a second line normal to a second point on the support contour may form between a ninety-degree angle and a one-hundred-and-eighty-degree angle, inclusive. The support contour may include an arc forming between a quarter-circle and a semi-circle, inclusive.

The one or more supports may include one or more rails. The one or more rails may be spaced such that an instance of the ball fitted to the arc having a Shore A hardness of 20 to a Shore A hardness of 35 rolls substantially unimpeded while continuous force is exerted against the ball toward the support contour by the human body.

A cord may be coupled to the rolling track for attachment to the ball, the cord permitting an instance of the ball fitted to the arc to roll substantially unimpeded along the rolling track as the cord rolls between the ball and the one or more supports.

In another embodiment, an apparatus for targeted myofascial release of an upper back and shoulders of a human body includes a rolling surface that is substantially vertical to permit motion of a ball in any direction while a human body exerts force against the ball toward the rolling surface for generation of myofascial release pressure. The rolling track includes one or more supports forming a support contour, the rolling track immovably fixable on the rolling surface. The one or more supports permit the ball to roll along the rolling track while a human body exerts force against the ball toward a point on the support contour, the rolling track open along an edge such that the human body can contact the ball. The opening along the edge also permits the human body to guide the ball out of the rolling track for a rolling surface substantially unimpeded at a first location along the rolling track and rejoin the rolling track from the rolling surface substantially unimpeded at a second location along the rolling track. The support contour faces concave down on the rolling surface to permit the ball to be held against gravity by the human body and for generation of downward myofascial release pressure against the upper back and shoulders.

The apparatus may include a friction surface of the rolling track that retains the ball in the rolling track when a force that is both parallel to the rolling surface and toward the support contour is exerted on the ball by the human body. The rolling surface may include a plurality of inlets to receive the one or more pegs of the rolling track to immovably fix the rolling track along the rolling surface. The one or more supports is a contoured surface that may be substantially smooth. A pivot may be connected to the rolling track, allowing the rolling track to adjustably rotate, and a pivot lock in coordination with the pivot may lock the rolling track in a track orientation after adjustably rotating.

In yet another embodiment, an apparatus for targeted myofascial release of an upper back and shoulders of a human body includes a ball having a connection point, the ball for providing a myofascial release pressure when force is applied against the ball by the human body. A cord is attached to a connecting point of the ball. A rolling surface that is substantially vertical permits motion of the ball in any direction while the human body exerts force against the ball toward the rolling surface.

Further included, a rolling track includes one or more supports forming a support contour, the rolling track immovably fixable relative to the rolling surface. The one or more supports permit the ball to roll along the rolling track while the human body exerts force against the ball toward the support contour, the rolling track forming an opening along an edge such that the human body can contact the ball and guide the ball out of the rolling track to the rolling surface substantially unimpeded at a first location along the rolling track and rejoin the rolling track from the rolling surface substantially unimpeded at a second location along the rolling track. The support contour can face concave down on the rolling surface permitting the ball to be held against gravity and for generating a myofascial release pressure downward against the upper back and shoulders of the human body, The ball and the cord permit the ball to roll substantially unimpeded along the rolling track when the cord rolls between the ball and the one or more supports. The ball and the cord permit the ball to roll substantially unimpeded along the rolling surface when the cord rolls between the ball and the rolling surface.

Other features will be apparent from the accompanying drawings and from the detailed description that follows.

BRIEF DESCRIPTION OF THE DRAWINGS

The embodiments of this specification are illustrated by way of example and not limitation in the figures of the accompanying drawings, in which like references indicate similar elements and in which.

Other features of the present embodiments will be apparent from the accompanying drawings and from the detailed description that follows.

DETAILED DESCRIPTION

Figure 1:
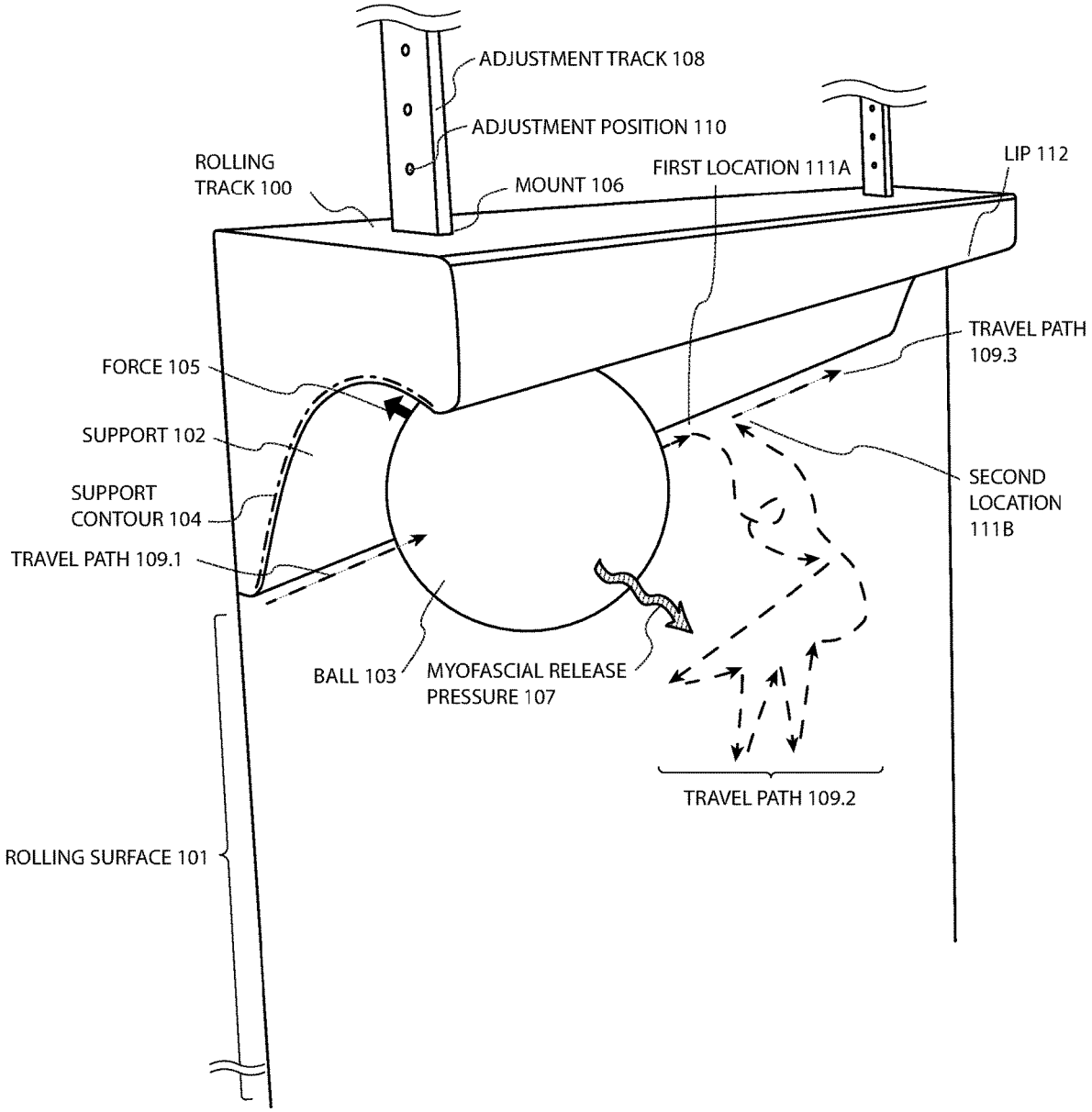
FIG. 1 is a rolling track for generating myofascial release pressure with a ball, the rolling track comprising a support contour in which the ball can be held and against which a force can be applied to generate opposed myofascial release pressure at a range of angles to target and resolve tension points, the rolling track transitioning to a rolling surface such that the ball can be guided out of the rolling track for the rolling surface to target additional sensed tension points, according to one or more embodiments.

Disclosed is an apparatus, a method, and/or a system of targeted myofascial release utilizing a rolling track. FIG. 1 illustrates a rolling track 100 comprising a support 102 forming a support contour 104. One or more mounts 106 may fix the rolling track 100 relative to a rolling surface 101. Force may be applied against a ball 103 placed in the support contour 104 by the body of a human user to generate myofascial release pressure 107. The rolling track is open along an edge such that the human body can remain in contact with the ball as it moves along the rolling track 100.

The rolling track may be mounted with a mount 106 to fix the position of the rolling track 100 relative to the rolling surface 101. The mount 106 may fix and/or fasten the rolling track directly to the rolling surface 101, or may fix and/or fasten the rolling track 100 to another object immobile relative to the rolling surface 101. The rolling track 100 may also be mounted to an adjustment track 108 with two or more adjustment positions 110 permitting the adjustment track 100 to be repositioned on the rolling track 100. For example, where the rolling surface 101 is substantially vertical (e.g., a wall), the adjustment track 108 may permit the rolling track 100 to movably adjust to accommodate a range of user heights such that the support contour will be proximate to a user's shoulder, neck, and upper back depending on a height of the user. In the embodiment of FIG. 1, the rolling track 100 is mounted to the adjustment track 108. The adjustment track 108 of FIG. 1 may, for example, be suspended from a mounting beam (e.g., the mounting beam 1000 of FIG. 10B) directly attached to the rolling surface 101.

Once the rolling track is immobilized, the user may guide the ball 103 along the rolling track 100, varying the direction of the force 105, a direction of travel along the rolling track 100, and a speed of the ball 103 to massage and resolve one or more tension points. The user may also decide to leave the rolling track 100 to the rolling surface 101 to "free-roll" without the influence of the support contour 104 to resolve one or more additional points of tension. For example, the user may first guide the ball 103 along a first travel path 109.1 while generating a first angle of myofascial release pressure. Second, the user may, while continuously applying force to the ball 103, leave the rolling track 100 at a first location 111A to the rolling surface 101 to free-roll along the rolling surface 101 via the travel path 109.2. The user may then return to a second location 111B on the rolling track to resume rolling in the rolling track 100 along travel path 109.3. A similar process may be repeated until the user achieves substantial progress in achieving myofascial massage and tension point release.

Figure 2:
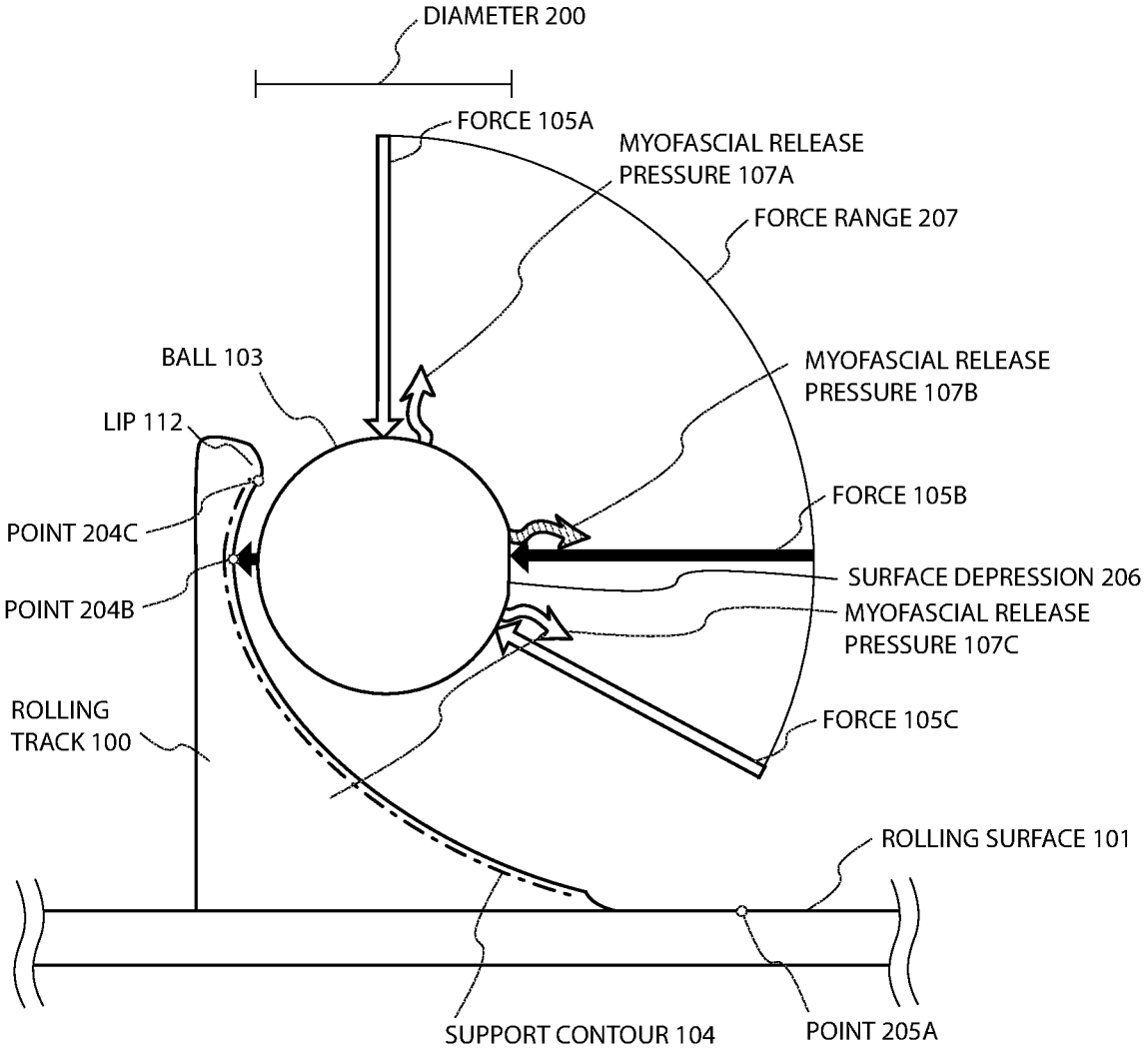
FIG. 2 is a cross-sectional view of the rolling track of FIG. 1 illustrating one example of the diameter of the ball relative to the support contour, a lip to hold the ball in the support contour, and a force range and associated set of opposed myofascial release pressures that may be generated with the support contour, according to one or more embodiments.
Figure 5:
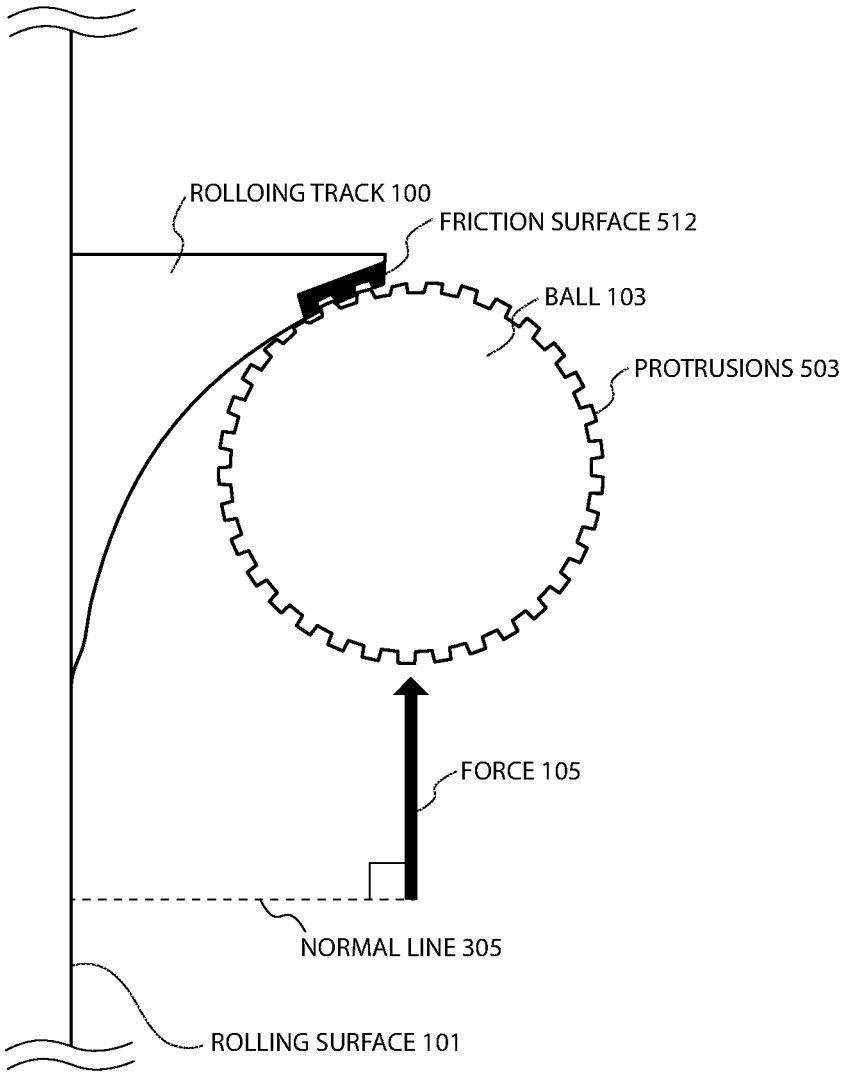
FIG. 5 illustrates a friction surface that may be utilized to hold the ball in the support contour when a force perpendicular to the rolling surface is applied to the ball, according to one or more embodiments.

Although optional, a lip 112 may aid in holding the ball 103 in the support contour depending on a direction of the force 105 applied to the ball 103, as shown and described in conjunction with FIG. 2. Alternate means of holding the ball 103 in place include a friction surface as shown in FIG. 5, or other systems and methods described in the present embodiments.

The rolling track 100 is usable in association with many instances of the rolling surface 101, for example a vertical surface (e.g., a wall, a door), a horizontal surface (e.g., a floor), or an oblique surface (e.g., a surface capable of tilting or a declinable or inclinable workout bench). As an illustration, when the rolling track 100 is used on a substantially horizontal surface, the rolling track 100 may be useful to massage the bottom of feet if standing or sitting proximate to the rolling track 100. When used on a substantially vertical surface, the rolling track 100 may be useful for generating down-pressure, including against the neck, shoulders, and back. This pressure may be achieved through primarily use of the leg muscles rather than the arms. The upper body may therefore remain relaxed, which may effect maximal muscular and myofascial release of the relaxed muscles, further shown and described in conjunction with FIG. 15 and FIG. 17.

Figure 8:
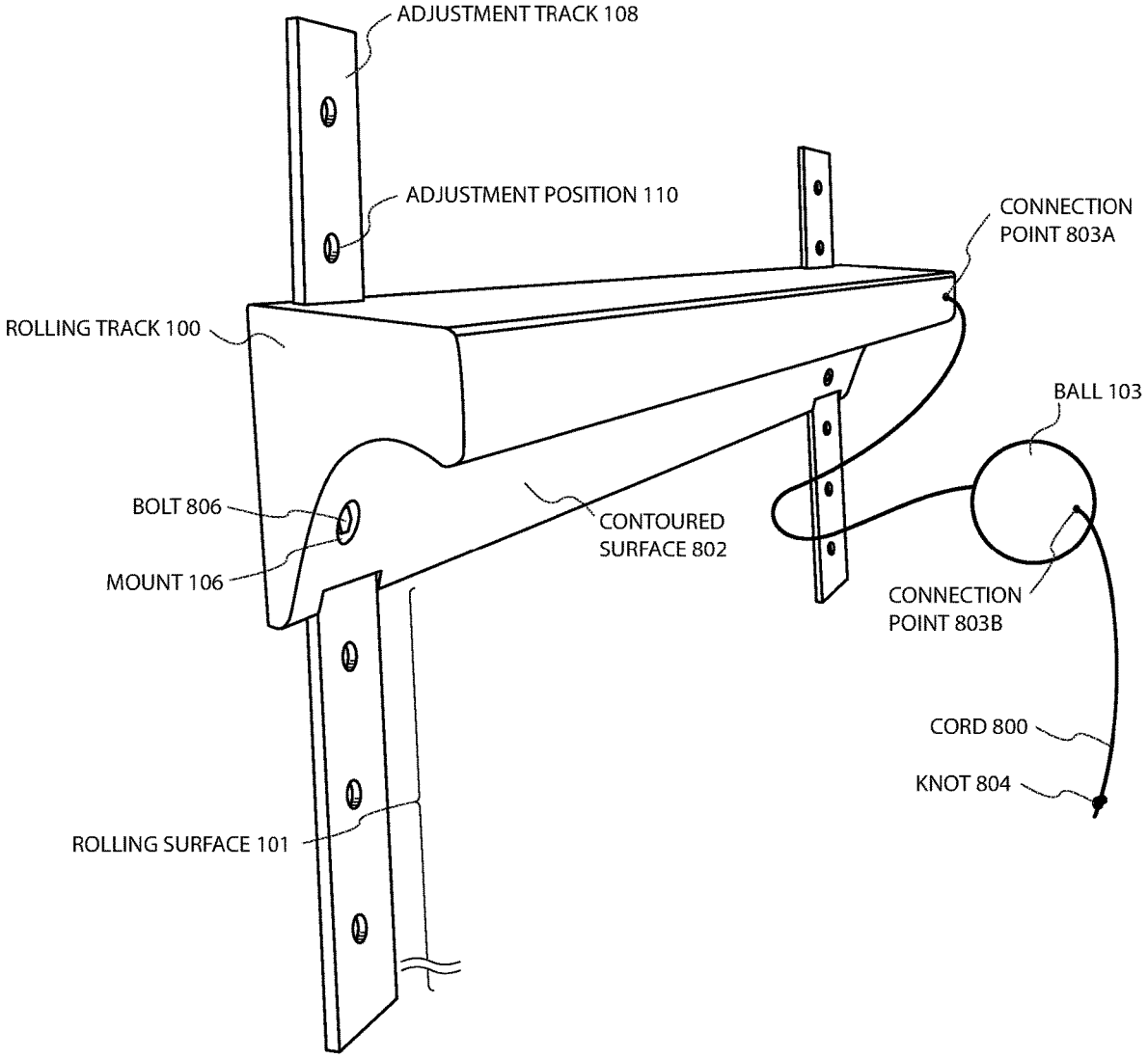
FIG. 8 illustrates an adjustment track comprising a plurality of adjustment positions on which the rolling track can be secured to fix a position of the rolling track relative to the mounting surface, and further illustrates the ball connected to the rolling track via a cord, according to one or more embodiments.

The rolling track 100 may comprise a single, contoured surface (e.g., the contoured surface 802 shown in FIG. 8, formed from the elongation of the support contour 104 comprised of a single support 102). The rolling track 100 may also comprise a broken surface forming the support contour 104, for example by rails 602 used to guide the ball 103, as shown and described in FIG. 6. The rolling track 100 may be made from a variety of materials or combination of materials, including wood, plastics, hard rubber, hard foam, metal, resin, fiberglass, or other similar materials. The rolling surface 101, if fabricated and/or integrated with the rolling track 100, may be made of the same variety of materials.

The rolling track 100 may be mounted in several ways to become secured relative to the rolling surface, as shown and described through the present embodiments. For example, the rolling track 100 may be bolted directly to a wall (e.g., screwed into studs), may be supported by a frame or rack to be free-standing, or may be suspended from a ceiling.

Figure 6:
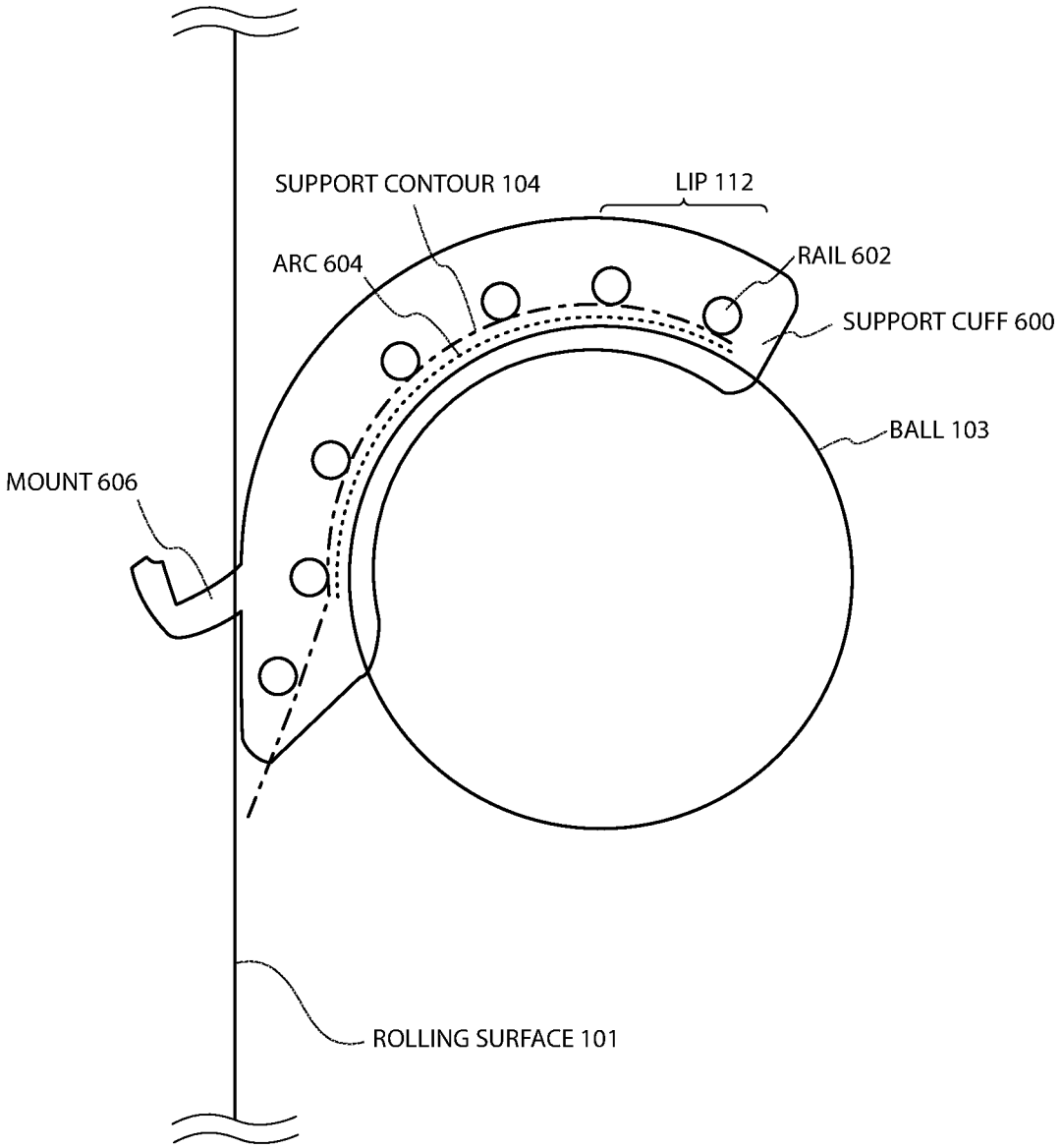
FIG. 6 is a side view of an instance of the rolling track in which a plurality of rails held in place by in a support cuff forms the support contour and a lip, a portion of the support contour comprising an arc matching a contour of one instance of the ball, the rolling track adjustably mountable on the rolling surface with a mount, according to one or more embodiments.
Figure 7:
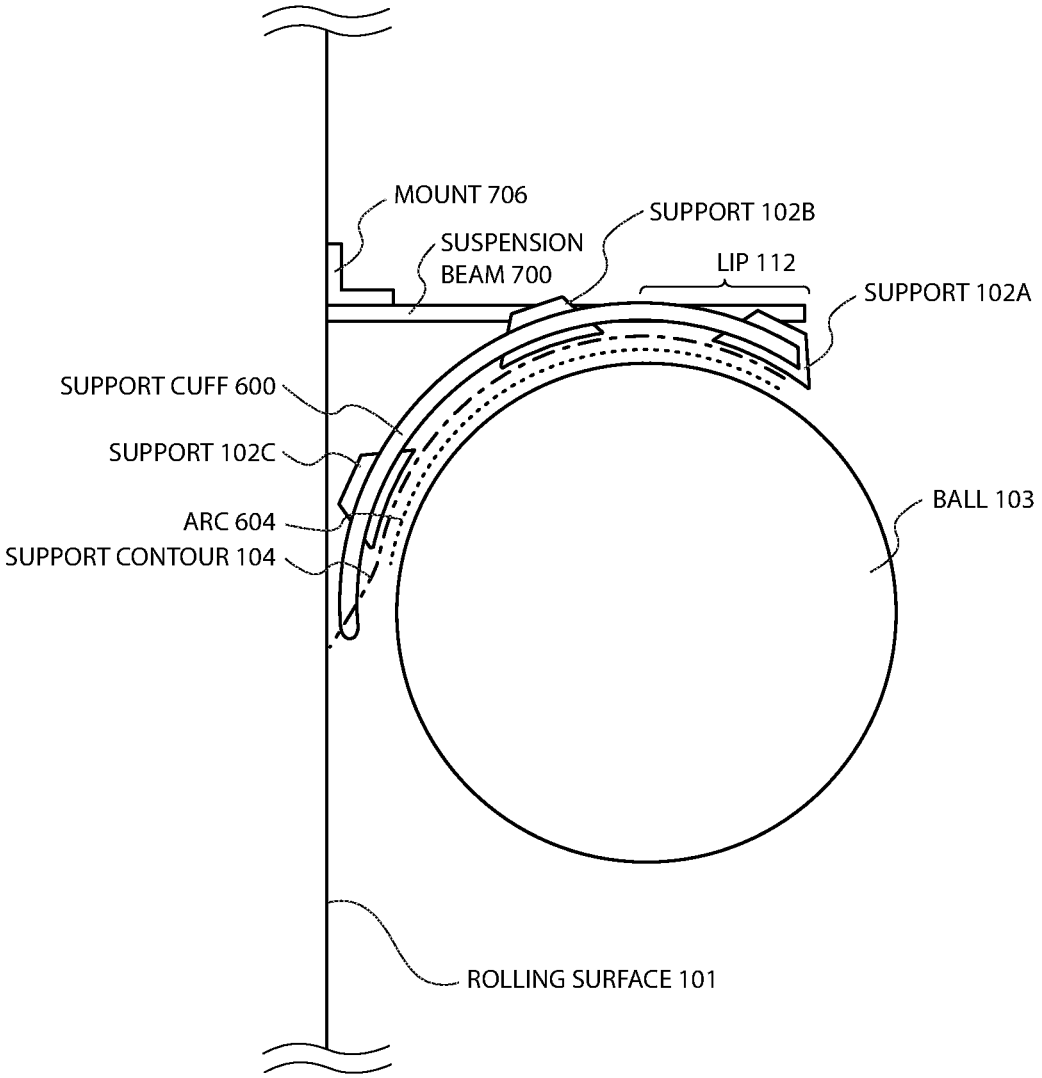
FIG. 7 illustrates an instance of the rolling track where the support contour and arc are formed with a plurality of supports matching the contour of an instance of the ball, according to one or more embodiments.

The support contour 104 may be defined by a single instance of the support 102 (e.g., forming a contoured surface 802), or may be made of a plurality of supports (e.g., as shown and described in conjunction with FIG. 6 and FIG. 7). The support contour 104 may take on a variety of shapes to permit different types and profiles of myofascial release pressure 107 to be generated, as for example shown in FIG. 1, FIG. 2, FIG. 4, FIG. 5, FIG. 7, FIG. 11). In one or more embodiments, part or all of the support contour 104 forms an arc (e.g., the arc 604) matching a contour of a ball 103 intended to be utilized with the rolling surface 101. In one or more embodiments, the several instances of the rolling track 100, each with a distinct support contour 104, may be attachable to a mounting system and/or the rolling surface 101, for example rolling track 100A and rolling track 100B shown and described in conjunction with FIG. 11.

The rolling track 100 accommodates the ball 103, which may be a ball suitable for myofascial release. The ball 103 may have a diameter between 2 inches and 4 inches (e.g., the diameter 200 of FIG. 2), and preferably a diameter between 2.5 inches and 3 inches. The ball 103 may be made of a polymer permitting some give, for example a mechanical rubber, a thermoplastic elastomer, plastics, natural rubber, or even an inflatable ball. The ball 103 may be a ball with a Shore A hardness of between 20 and 80 durometers. In one or more embodiments, the Shore A hardness may be between 20 and 35 durometers, and preferably between 28 and 32 durometers. In one or more preferred embodiments, the ball 103 may have a diameter of 2.75 inches and a shore A hardness of 30 durometers. The ball 103 may be coupled to the rolling track 100 as shown and described in FIG. 8. The ball 103 may be coupled to the rolling track 100 either by direct connection or by connection to another element connected to the rolling track 100. The ball 103 may have a texture, such as surface protrusions, as may be known in the art to aid in myofascial release.

The rolling surface 101 may be any surface suitable for free-rolling of the ball 103 to generate myofascial release pressure 107. For example, the rolling surface 101 may be an interior wall (e.g., of a home or gym), a floor, or one or more wooden boards. The rolling surface 101 may have a texture (e.g., brick, cracks between wooden boards). In one or more embodiments the rolling surface 101 may be integrated with the rolling track 100, for example fabricated as a single piece.

For a given instance of the rolling track 100 and a set of one or more balls 103 intended to work with the rolling track 100, the one or more supports 102, the support contour 104, and the rolling surface 101 should be selected such that the balls 103 roll substantially unimpeded along each surface when continuous force is applied to each of the balls 103 by the user. A small amount of resistance is acceptable, for example a slight bump in transitioning between the support 102 and the rolling surface 101. A depression requiring some force to move the ball 103 between the support contour 104 and the rolling surface 101 may be advantageous. Such a depression may even dip below the rolling surface 101, for example where the rolling surface 101 and rolling track 100 are manufactured as a single piece. Where a plurality of rails 602 are utilized as the supports 102, the distance of the rails 602 (as shown and described in conjunction with FIG. 6) should be selected such that the set of balls 103 intended to be used in the rolling track 100 will not wedge between the rails when force is applied against the ball 103 toward the support contour 104.

FIG. 2 is a cross-sectional view of the rolling track 100 of FIG. 1 illustrating one example of the diameter 200 of the ball 103 relative to the support contour 104, illustrating the lip 112 to hold the ball 103 in the support contour 104, and illustrating a force range 207 (e.g., the force 105A through 105C) and associated set of myofascial release pressures 107A through 107C that may be generated with the support contour 104, according to one or more embodiments. In the embodiment of FIG. 2, the ball 103 may move along any point of the support contour 104 depending on where the human body directs the ball 103 while in contact with the ball 103. A range of forces, the force range 207, may be applied to generate a range of corresponding myofascial release pressures 107. For example, where the ball 103 is held against the rolling surface 101 (e.g., at the point 205A), the force 105A may be applied to generate the myofascial release pressure 107A opposed to the force 105A.

Where the ball 103 is held in the support contour 104 and the force 105B represented by the black arrow in FIG. 2 is generated by the human body in contact with the ball 103 toward the point 204B on the support contour 104, the myofascial release pressure 107B may be generated. Similarly, without substantially moving from the position in which the myofascial release pressure 107B was generated, due to the curvature of the support contour 104 and the lip 112, the force 105B may be applied toward the point 204B to generate the myofascial release pressure 107B without the ball 103 slipping from the rolling track 100. The force range 207 therefore represents the range of forces 105 the user may be able to exert while the ball 103 remains static for a given combination of the support contour 104 and the rolling surface 101 (along with corresponding opposed instance of the myofascial release pressure 107). Finally, a surface depression 206 of the ball 103 is shown (not necessarily to scale) from the application of the force 105B. The ball 103 may exhibit such a surface depression 206 on either the point (e.g., the point 205A, the point 204B) to which force 105 is applied, and/or the opposite side of the ball 103 where the corresponding myofascial release pressure 107 is generated. The extent of surface depression 206 may depend on the Shore hardness durometer of the ball 103 and the force 105 applied, and may aid in working out tension points by distributing the pressure over a wider area to loosen surrounding muscle tissue and fascia, as shown and described in conjunction with FIG. 16.

Figure 3A:
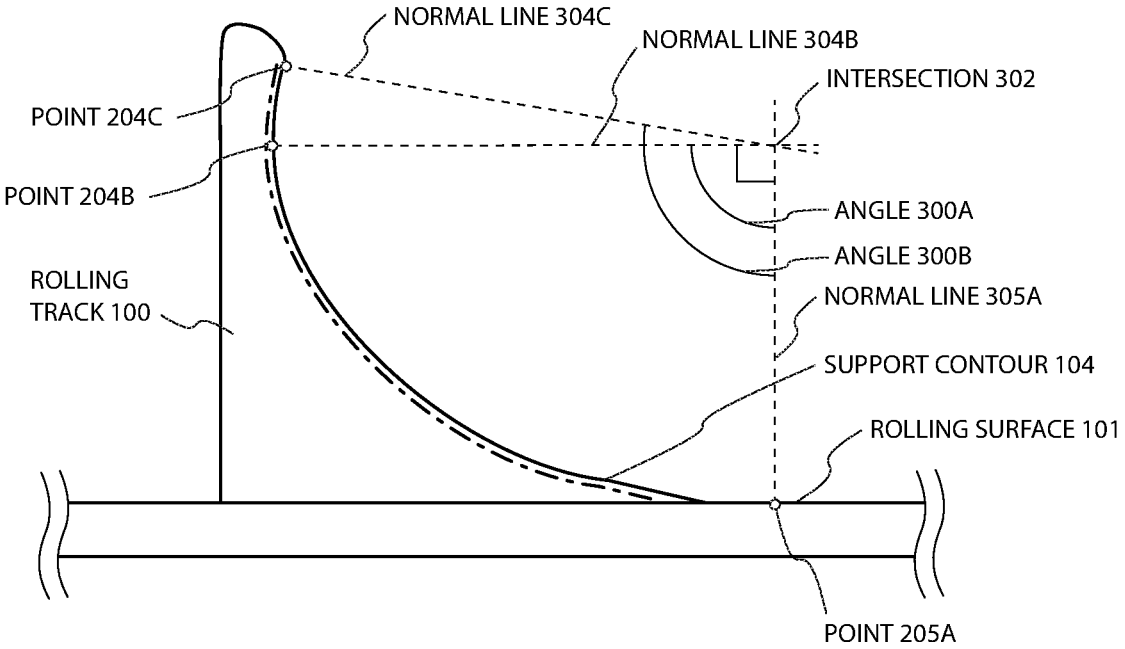
FIG. 3A illustrates an angle formed by an intersection of a normal line normal to a point on the support contour and a normal line normal to the rolling surface, the normal lines and angles used for illustrating further aspects of the present embodiments, according to one or more embodiments.

FIG. 3A illustrates angles 300A and 300B formed by an intersection 302 of three normal lines, a normal line 304B normal to a point 205B on the support contour 104, a normal line 305A normal to the rolling surface 101, and a normal line 304C normal to a point 204C on a lip of the support contour 104. FIG. 3A may be used for illustrating and describing further aspects of the present embodiments, including for example to describe the relationship between the support contour 104 and the rolling surface 101. The normal line 304 is generally a line normal to a point 204 on the support contour 104. The normal line 305 is a line normal to a point 205 on the rolling surface 101. In the embodiment of FIG. 3A, the normal line 304B is a line normal to the support contour 104 at the point 204B, and the normal line 304C is a line normal to the rolling surface 101 at a point 205C. The intersection 302 of the normal line 305A and the normal line 304B results in the angle 300A. In the embodiment of FIG. 3A, the angle 300A is ninety degrees. In the embodiment of FIG. 3A, the normal line 304C is a line normal to support contour 104 at the point 204C. The intersection 302 of the normal line 305A and the normal line 304C results in the angle 300B. In the embodiment of FIG. 3A, angle 300B represents a maximum instance of the angle 300 formed from a normal line 304 normal to a point 204 on the support contour and a normal line 305 normal to a point 205 on the rolling surface 101. In one or more embodiments, the maximum instance of the angle 300 (formed from a normal line 304 normal to a point 204 on the support contour and a normal line 304 normal to a point 204 on the rolling surface 101) may be in a range from 90 degrees up to and including 180 degrees. Where the support contour 104 includes an arc 604 matching a contour of the ball, a cross-section of a quarter-circle to a half-circle, inclusive, may result from this geometry.

Figure 3B:
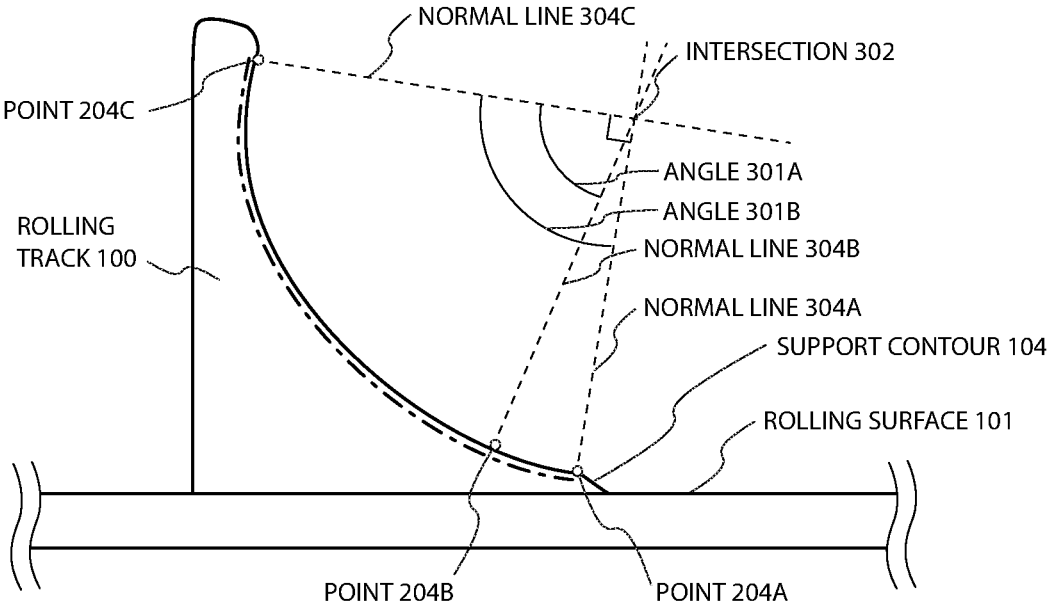
FIG. 3B illustrates an angle formed by an intersection of a normal line normal to a first point on the support contour and a normal line normal to a second point on the support contour, similarly used for illustrating further aspects of the present embodiments, according to one or more embodiments.

FIG. 3B similarly illustrates an angle 301A and 301B formed by an intersection 302 of a normal line 304A normal to a first point 205A on the support contour 104, a normal line 304B normal to a second point 205B on the support contour 104, and a normal line 304C normal to a third point 204C on the support contour 104. FIG. 3B may be used for illustrating and describing further aspects of the present embodiments. FIG. 3B is similar in operation to FIG. 3A, but the angle 301 represents an internal angle between two arbitrary points 204 on the support contour 104. The angle 301B of FIG. 3B illustrates the maximum angle of the intersection 302 of normal lines 304 normal to two points 204 on the support contour (in the embodiment of FIG. 3B, the maximum angle is ninety degrees). In one or more embodiments, the maximum instance of the angle 301 (formed from a normal line 304A normal to a first point 204A on the support contour and a normal line 304C normal to a second point 204C on the support contour 104) may be in a range from 90 degrees up to and including 180 degrees. Where the support contour 104 includes an arc 604 matching a contour of the ball, a cross-section of a quarter-circle to a half-circle, inclusive, may result from this geometry.

Figure 4:
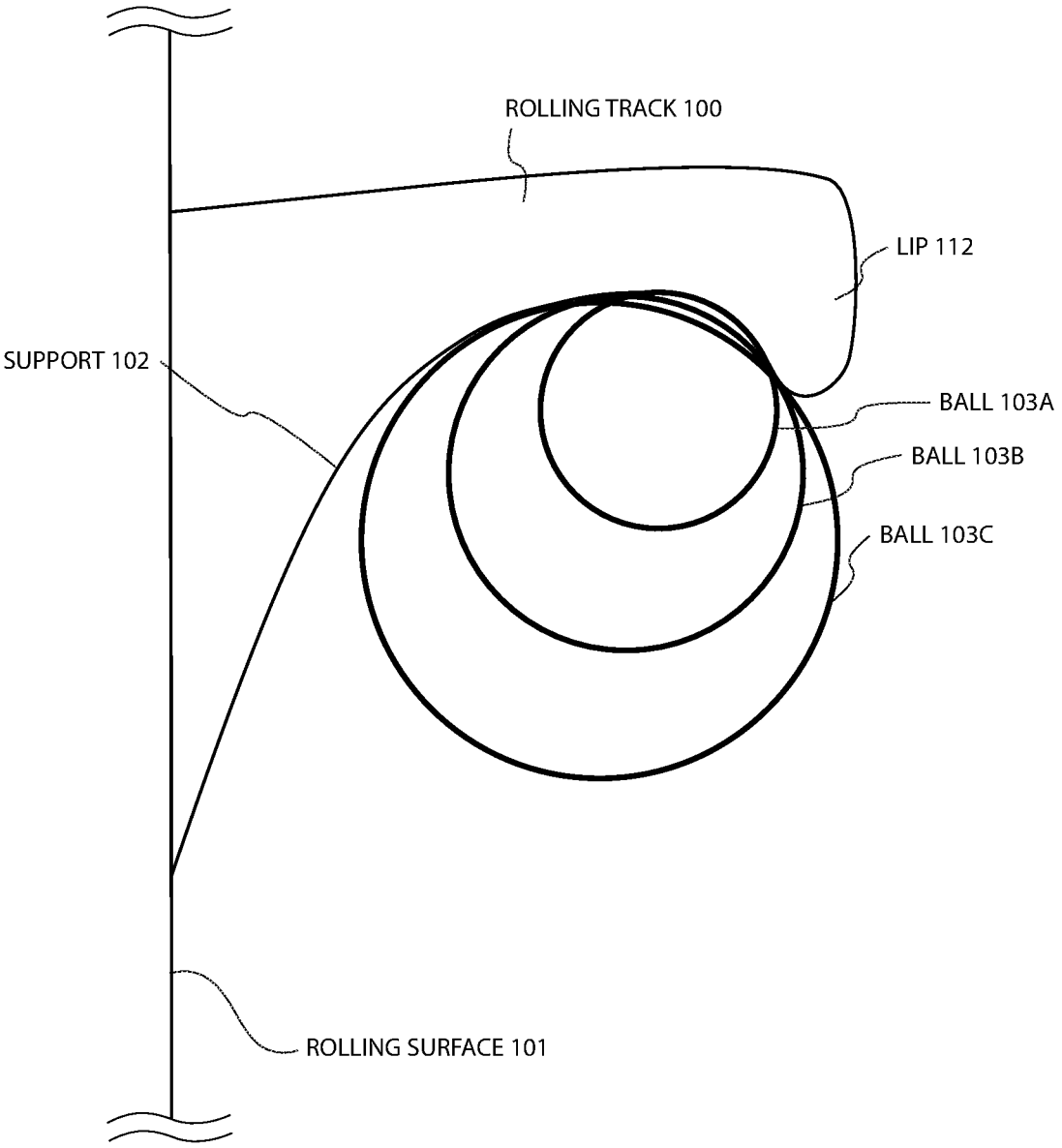
FIG. 4 illustrates several sizes of the ball of FIG. 1 in an instance of the support contour for generating different strengths and distributions of myofascial release pressure, according to one or more embodiments.

FIG. 4 illustrates several sizes of the ball 103 of FIG. 1 in an instance of the support contour 104 for generating different strengths and distributions of myofascial release pressure 107, according to one or more embodiments. Specifically, the embodiment of FIG. 4 illustrates that a single instance of the rolling track 100 and/or the support contour 104 may accommodate sizes and types of the ball 103. For example, for an instance of the rolling track 100 immobilized relative to a substantially vertical surface, the ball 103A may have a diameter of 2 inches and may be used to generate direct down-pressure (e.g., the myofascial release pressure 107) on the top of the shoulder and/or where the user desires a high pressure. Similarly, the ball 103B may have a diameter of 3 inches and may be used to generate pressure on the upper back, shoulders and neck when the user desires a medium myofascial release pressure 107. The ball 103C may have a 4 inch diameter and be primarily usable to release tension in the upper-middle back, and when the user desires to generate a more gentle instance of the myofascial release pressure 107. Depending on size of the ball 103A, the ball 103B, and the ball 103C, a given instance of the support contour 104 may have a different force range 207 depending on the extent to which the support contour 104 and/or the lip 112 may retain the instance of ball 103 in the support contour 104 when the force 105C of FIG. 2 is applied.

FIG. 5 illustrates a friction surface 512 that may be utilized to hold the ball 103 in the support contour 104 when a force 105 perpendicular to the rolling surface 101 (i.e., perpendicular to a normal line 304 normal to a point 204 on the rolling surface 101 is applied to the ball 103), according to one or more embodiments. In the present embodiments, the rolling track 100 utilizes the support contour 104 to enable the force range 207 and the corresponding opposing myofascial release pressures 107. One preferred instance of the force 105 to permit when using the rolling track 100 is the force 105 that may be generally toward the support contour 104 but parallel to the rolling surface 101. A means of providing friction enables this instance of the force 105 to prevent the ball 103 from slipping out of the rolling track 100. For example, one way to permit the force 105 parallel to the rolling surface 101 is to include the lip 112 of the rolling track 100, as shown in FIG. 1, FIG. 2, FIG. 3A, FIG. 3B, and FIG. 4. Another means of friction is illustrated in FIG. 5 as the friction surface 512. The friction surface 512 may be made of a gripping surface or a material of high friction, for example rubber, and create substantial surface friction to hold the ball 103 in contact with the support contour 104 when the force 105 generally toward the support contour 104 and parallel to the rolling surface 101 is applied by the user. The friction surface 512 may also comprise texture or depressions, including but not limited to texture and depressions matched to the texture of a particular instance of the ball 103 intended for use with the rolling track 100. In the embodiment of FIG. 5, the ball 103 is shown with protrusions 503 that may fit within the texture and/or depressions of the friction surface 112 to increase surface area and friction. However, in one or more other embodiments not shown, the friction surface 512 may be substantially smooth and may not have the texture or depressions. Although shown on the end of the support contour 104, the friction surface 512 may coat the entire support contour 104, or for example each rail 602 of the embodiment of FIG. 6, described next.

FIG. 6 is a side view of an instance of the rolling track 100 in which a plurality of rails 602 held in place by a support cuff 600 forms the support contour 104 and lip 112, a portion of the support contour 104 comprising an arc 604 matching a contour of the ball 103, the rolling track 100 adjustably mountable on the rolling surface 101 with a mount 606, according to one or more embodiments. In the embodiment of FIG. 6, a plurality of rails 602 act as the supports 102, the plurality or rails forming the support contour 104. Although rails 602 are shown with a round cross-section, the rails 602 may have a variety of cross-sectional shapes. The rails 602 are held in configuration by the support cuff 600. For example, the rails may be made of metal (e.g., a powder-coated steel) and welded to the support cuff 600.

A portion of the support contour 104 forms the arc 604 that may be matched to a contour of a specific instance of the diameter 200 of the ball 103. The lip 112 may be formed by two instances of the rails 602 furthest from the rolling surface 101 when the rolling track 100 is immobilized relative to the rolling surface 101. The rails 602 should be placed such that the instance of the ball 103, accounting for both Shore hardness and the diameter 200 of the ball 103, can move substantially unimpeded along the rolling track 100 and over the rails 602 to join the rolling surface 101. For example, if the ball 103 is too soft or small relative to the spacing of the rails 602, the ball 103 may get wedged between the rails 602 when the force 105 is applied toward the support contour 104 by the human body, or may feel overly jerky or bumpy when transitioning between the support contour 104 and the rolling surface 101. The mount 606 may be a hook that may be inserted into a mounting hole such as an instance of the adjustment position 110. The embodiment of the rolling track of FIG. 6 is further used as the specific instance of the rolling track 100 in the embodiment of FIG. 9.

FIG. 7 illustrates an instance of the rolling track 100 where the support contour 104 and arc 604 are formed with a plurality of supports 102A through 102C matching a contour of an instance of the ball 103, according to one or more embodiments. FIG. 7 includes similar aspects to the embodiment of FIG. 6, but each support 102A includes a curvature partially matching the arc 604. The embodiment of FIG. 7 may include a suspension beam 700 connected to one or more of the supports 102 (e.g., the support 102A and the support 102B) and/or the support cuff 600. The suspension beam 700 may be mounted to the rolling surface 101 with the mount 706.

FIG. 8 illustrates an adjustment track 108 comprising a plurality of adjustment positions 110 on which the rolling track 100 can be secured to fix a position of the rolling track 100 relative to the rolling surface 101, the rolling track 100 of FIG. 8 further illustrating the ball 103 connected to the rolling track 100 via a cord 800, according to one or more embodiments. In the embodiment of FIG. 8, the adjustment track 108 is a set of parallel adjustment tracks that may be affixed to the rolling surface 101, for example with screws, nails, bolts, glue, or other methods of fastening depending on the particular rolling surface 101 intended for use. Each adjustment position 110 may comprise a hole with screw threads, a hole forming a friction-fit with a peg to be inserted, a hole to receive a hook mount, or interact in another fashion to fasten and/or fix the rolling track 100 at the adjustment position 110. The contoured surface 802 is formed from the elongation of the support contour 104 comprised of a single support 102 (the contoured surface 802 is also present in other instances of the present embodiments, e.g., in FIG. 1, FIG. 2, FIG. 3, FIG. 4, and FIG. 5). Specifically, in FIG. 8, the mount 106 comprises a through-hole in the contoured surface 802 of the rolling track 100, a bolt 806 screwing into threads of each adjustment position 110 of FIG. 8.

Figure 9:
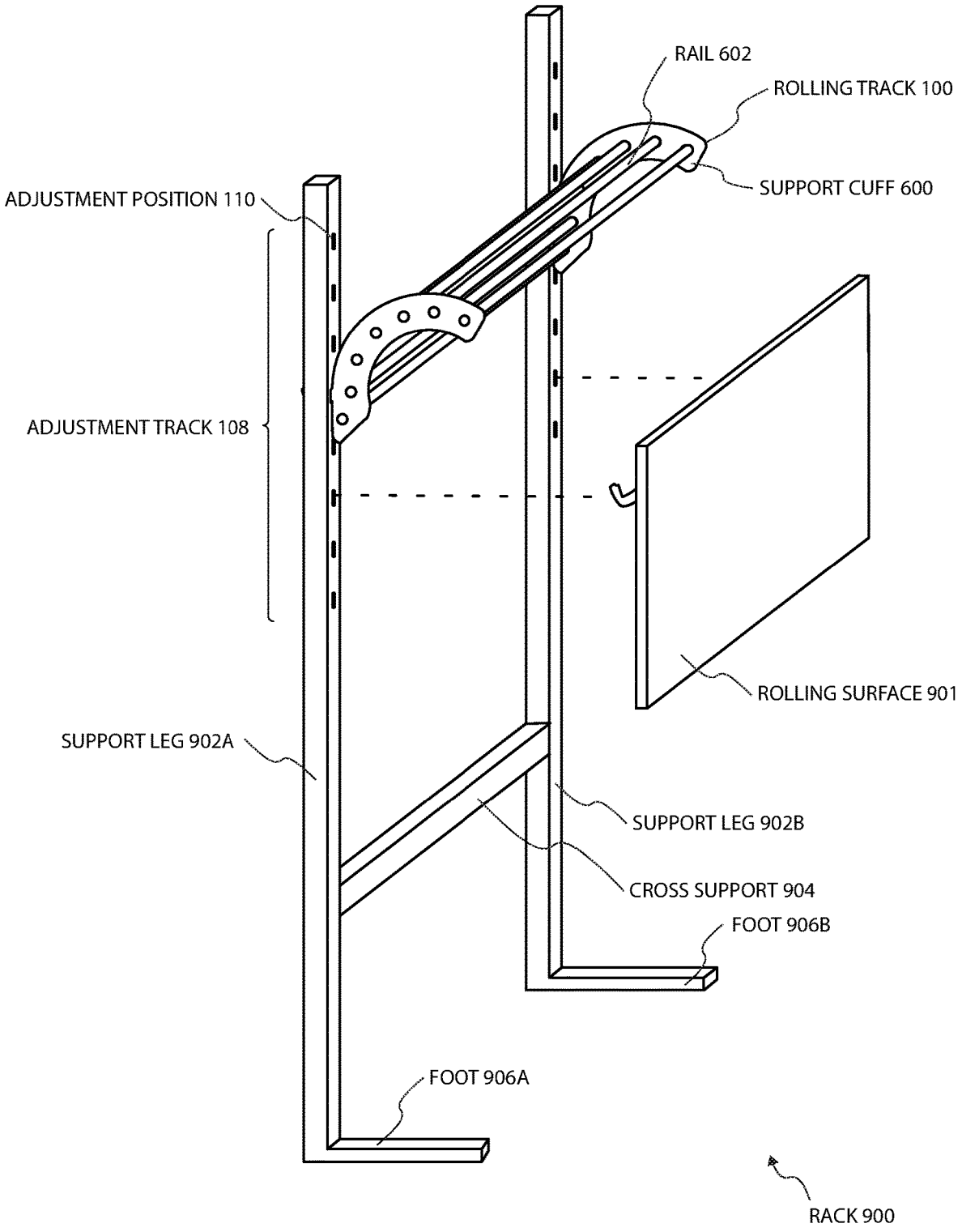
FIG. 9 illustrates the rolling track of FIG. 6 mounted on a rack to act as a freestanding station for a user to utilize the rolling track, the rack comprising a pair of parallel support legs having included the adjustment track as a plurality of holes to receive mounting hooks of the rolling track, the rolling surface also adjustably mounting below the rolling track, according to one or more embodiments.
Figure 11:
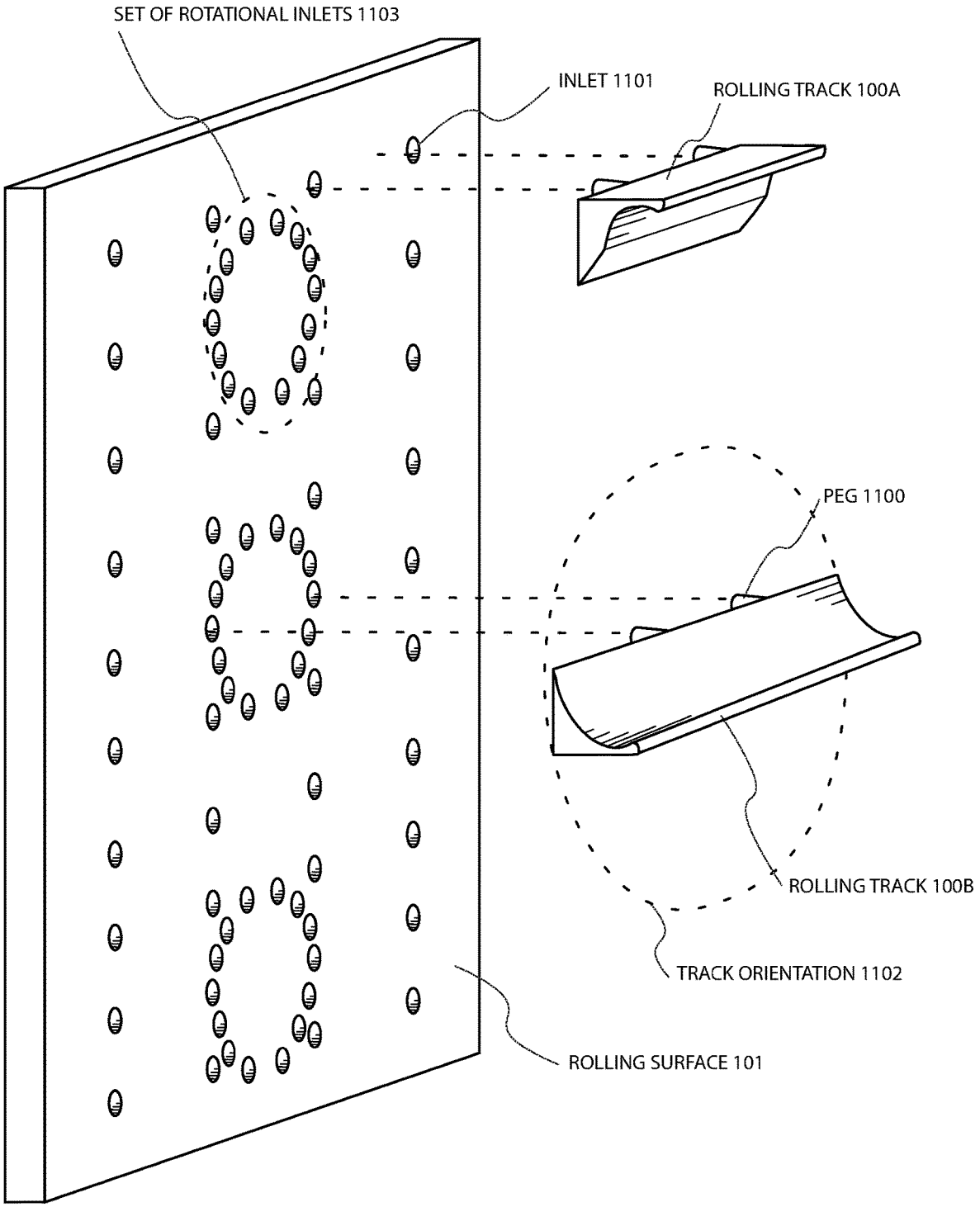
FIG. 11 illustrates a rolling surface with a plurality of inlets and two rolling tracks with corresponding pegs fitting the inlets, the matching inlets and pegs enabling the rolling tracks to be positioned in a variety of locations and track orientations to generate versatile myofascial release pressure angles, according to one or more embodiments.

As shown in the embodiment of FIG. 8, the ball 103 may be coupled to the rolling track 100, either by a direct connection to the rolling track (e.g., via connection point 803A as shown in FIG. 8) or by connection to another element or component associated with the rolling track 100 (e.g., the adjustment track 108, a support leg 902 of FIG. 9, the rolling surface 101 of FIG. 11). While coupling one or more instances of the ball 103 is not necessary, it may increase effectiveness of the myofascial release pressure being that an instance of the ball 103 matched to the rolling track 100 is utilized, it may create a comprehensive product for sale, it may prevent the ball 103 from getting lost, and/or present other optional advantages. In one or more embodiments, the cord 800 is a nylon cord, for example 550 pound test-weight ("five-fifty parachute cord") or 400 pound test-weight cord. In one preferred embodiment, the cord is soft and has a diameter of 0.04 inches to 0.20 inches. The cord is attached to the ball 103 via a connection point 803B. The connection point 803B may be any method of reliably attaching the ball 103 to the cord 800, for example drilling a hole in the ball 103, inserting the cord 800, and applying a glue to secure the cord in the hold. Specifically in the embodiment of FIG. 8, the ball 103 comprises a through-hole through which the cord 800 is run, with a knot 804 larger than the through-hole tied in one end of the cord 800.

The cord 800 should be selected such that the ball 103 is substantially unimpeded when it rolls over the cord 800 as the user generates myofascial release pressure 107. For example, the ball 103 may roll over the cord 800 as the cord 800 comes between the ball 103 and the contoured surface 802 and/or when the cord 800 comes between the ball 103 and the rolling surface 101. For example, the cord 800 may be flexible and/or a cross-section substantially collapsible to permit the ball to roll over the cord substantially unimpeded, e.g., without the ball 103 catching as it rolls while continuous pressure is applied by the human body. In one or more preferred embodiments, a ball 2.75 inches in diameter and 25 Shore A hardness durometer made of rubber is utilized with a nylon cord 0.16 inches in diameter. The through-hole shown in FIG. 8 as connection point 803B may permit the ball to slide along the cord 800, which may additionally prevent the cord 800 from tangling or bunching under the ball 103. In one or more embodiments the cord 800 and the through-hole may form a friction-fit such that the ball 103 remains in a static position on the cord unless manual manipulation or force is applied to the ball 103.

FIG. 9 illustrates the rolling track 100 of FIG. 6 mounting on a rack 900 as a freestanding station for a user to utilize the rolling track 100, the rack 900 comprising a pair of parallel support legs 902A and 902B having included the adjustment track 108, the rolling surface 101 also adjustably mounting below the rolling track 100, according to one or more embodiments. The embodiment of FIG. 9 utilizes the rolling track shown and described in conjunction with FIG. 6. However, other embodiments (e.g., the embodiment of FIG. 8) may also be used with an appropriate instance of the mount 106, for example by replacing adjustment position 110 with threaded holes to accommodate the bolt 806 of FIG. 8. In the embodiment of FIG. 9 the rack 900 may act as a free-standing station where a user may utilize the rolling track 100. The rack 900 may be placed against a wall, with the wall acting as the rolling surface 101. Alternatively, a detachable instance of the rolling surface 101 (e.g., the rolling surface 901) may also be mounted on the rack 900 below the rolling track 100. Where the rolling surface 901 is utilized the rack 900 may be positioned away from a wall. In one or more embodiments, the rack 900 to permit freestanding use of the rolling track 100 may be built in a variety of ways, but in the embodiment of FIG. 9 it comprises two parallel support legs 902 each comprising a set of adjustment positions 110 forming the adjustment track 108. A cross support 904 connects the support legs 902A and 902B, and a foot 906A and 906B connected to each support leg 902A and 902B, respectively, permits the rack 900 to stand on a horizontal surface such as the floor. To prevent the rack 900 from moving when the user applies force against the ball 103 in the support contour 104 and/or the rolling surface 901, the rack 900 may be bolted to the wall, bolted to the floor, include a board resting on each foot 906 on which the user can stand to counteract their applied force 105, or the rack 900 may be of sufficient weight to prevent the user from lifting or tipping the rack 900 when the user applies force against the ball 103.

Figure 10A:
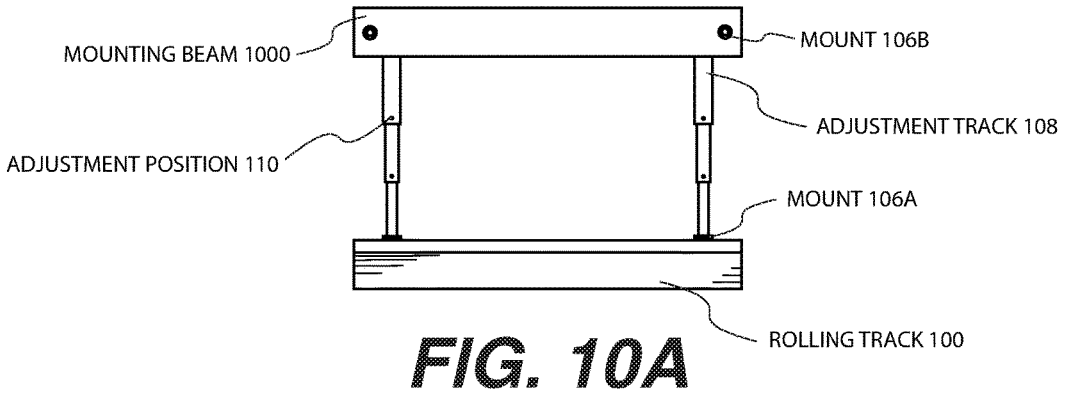
FIG. 10A illustrates a wall-mountable rolling track utilizing a pair of telescoping tubes as the adjustment track, the telescoping tubes descending from a mounting beam that can be mounted to a wall and lockable in two or more adjustment positions to adjust to a vertical height, according to one or more embodiments.

FIG. 10A illustrates a wall-mountable rolling track 100 utilizing a pair of telescoping tubes as the adjustment track 108, the telescoping tubes descending from a mounting beam 1000 (e.g., that can be mounted to a wall) and lockable in two or more adjustment positions 110 to adjust a vertical height of the rolling track 100 to accommodate different users, according to one or more embodiments. The mounting beam 1000 may be a board or other member with instances of the mount 106 (e.g., the mount 106B) usable to mount the mounting beam 1000 to a wall, ceiling and/or the rolling surface 101. The rolling track 100 is mounted via the mount 106A to each adjustment track 108. The adjustment track 108, specifically in the embodiment of FIG. 8 the telescoping tube, may be a plurality of tubes of various sizes able to slide into one another in a coaxial fashion to increase or decrease an overall length of the collection of tubing. Each connection may have a female and a male end where two diameters of tubing slide into one another. The telescoping tubes may include locks, for example a clasp or cuff preventing the collapse or extension of the telescoping tubes, resulting in one or more adjustment positions 110. In one or more other embodiments, including the embodiments of FIG. 10A, the telescoping tubes may include a small hole at the female end of each tube, with a spring-loaded button in a male end of a connecting tube protruding into the hole to lock the telescoping tube into an adjustment position 110.

Figure 10B:
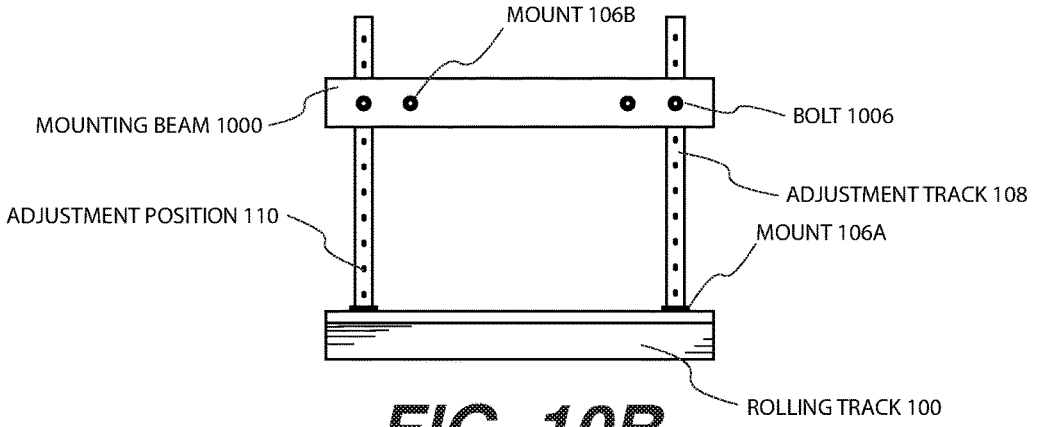
FIG. 10B illustrates another instance of a wall-mountable rolling track comprising parallel tracks sliding through the mounting beam and securable at an adjustment position using a bolt, according to one or more embodiments.

FIG. 10B illustrates another instance of a wall-mountable rolling track 100 comprising parallel adjustable tracks 108 sliding through the mounting beam 1000 and securable at an adjustment position 110 using a bolt 1006, according to one or more embodiments. Each adjustment position 110 may have screw threads to accommodate the bolt 1006. Alternatively, a pin may be used in place of the bolt 1006 with each adjustment position 110 accommodating the pin.

Figure 10C:
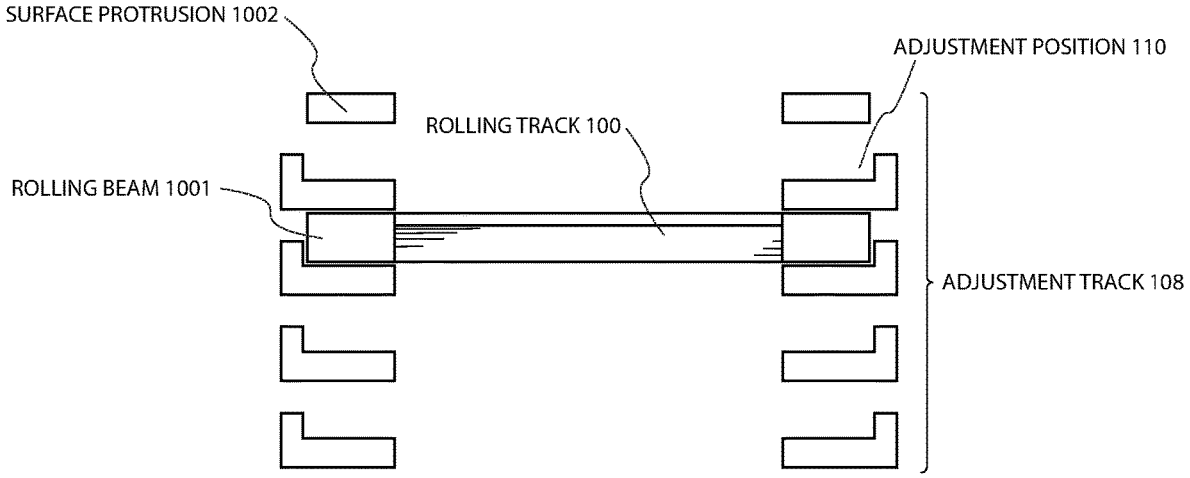
FIG. 10C illustrates yet another instance of a wall-mountable rolling track comprising parallel sets of surface protrusions across which a rolling beam comprising the rolling track may be placed, according to one or more embodiments.

FIG. 10C illustrates yet another instance of a wall-mountable rolling track 100 comprising parallel sets of surface protrusions 1002 across which a rolling beam 1001 comprising the rolling track 100 may be placed, according to one or more embodiments. The rolling beam 1001 may be an instance of the rolling track 100 with additional side members to support the rolling track 100. The surface protrusions 1002 may protrude sufficiently to prevent the rolling beam 1001 from falling out of the adjustment track 108 during application of the force 105 by the user against the rolling track 100. For example, where the lip 112 protrudes four inches from a wall, the surface protrusion 1002 may be three to five inches. Additional mechanisms may be utilized to lock the rolling beam into place along the adjustment track 108 of FIG. 10C, for example a friction coating applied to each surface protrusion 1002.

FIG. 11 illustrates a rolling surface 101 with a plurality of inlets 1101 and two rolling tracks (a rolling track 100A and a rolling track 100B) with corresponding pegs 1100 fitting the inlets 1101, the matching inlets 1101 and pegs 1100 permitting the rolling tracks 100A and/or 100B to be positioned in a variety of locations, and rotational inlets 1103 enabling the rolling track 100A and/or 100B to be positioned in multiple track orientations 1102 to generate versatile myofascial release pressure angles, according to one or more embodiments. In the embodiment of FIG. 11, the rolling track 100 may be a wall, a floor, or may be a free-standing surface (e.g., utilizing a foot or base not shown). The rolling surface 101 of FIG. 11 includes a plurality of inlets 1101, which may form a peg board. In one or more embodiments, one or more pegs 1100 corresponding to the inlet 1101 may protrude from the rolling track 100. The user may select a location on the rolling surface 101 to input the rolling track 100. For example, where the rolling surface 101 of FIG. 11 is in a vertical orientation, the user may place the rolling track 100 at waste-level so that the user may generate the myofascial release pressure 107 for the buttocks or hips. Similarly, the user may place the rolling track 100 at knee-level to release tension in the calves or other leg muscles, or at chest level to work upon the arms. The peg 1100 and the inlet 1101 may form a friction fit or may utilize other locking mechanisms to secure the peg 1100 and the inlet 1101. The inlet 1101 and the peg 1100 may be a variety of shapes, for example a cross-section of the peg 1100 may be square, elliptical, hexagonal or another shape. In one or more embodiments a single peg 1100 may protrude from the rolling track 100. The pegs 1100 may protrude form a variety of locations on the rolling track 100, but in one or more preferred embodiments are placed in the middle of the rolling track 100.

As shown in FIG. 11, a rolling track 100A may have a first type of support contour 104 e.g., a support contour 104A, not labeled, that may primarily accommodate a relatively small instance of the ball 103), and a second rolling track 100B may have a second type of support contour 104 (e.g., a support contour 104B, not labeled, that may primarily accommodate a larger instance of the ball 103). Each rolling track 100 may also be oriented in a variety of ways on the rolling surface 101 with the inlets 1101. For example, where the rolling surface 101 is vertical and the plurality of inlets 1101 form a grid, the rolling track 100A may be placed in a concave down position (e.g., as shown by the rolling track 100A in FIG. 11), or a concave up position (e.g., as shown by the rolling track 100B in FIG. 11). The rolling track 100 may also be placed sideways, for example permitting the user to apply the force 105 toward the support contour in a horizontal direction, e.g., that is simultaneously parallel to both the vertical instance of the rolling surface 101 and the floor. In addition, groups of inlets 1101 may be distributed in various irregular patterns, such as into a set of rotational inlets 1103. The set of rotational inlets 1103 may permit the rolling track 100 to be positioned by the user in a number of track orientations 1102. In the embodiment of FIG. 11, three sets of rotational inlets 1103 are present on the rolling surface 101, each comprised of fourteen instances of the inlet 1101 and permitting seven track orientations 1102. Fewer or more of the set of rotational inlets 1101, or fewer or more of the rolling track orientations 1102, may be utilized on the rolling surface 101.

Figure 12:
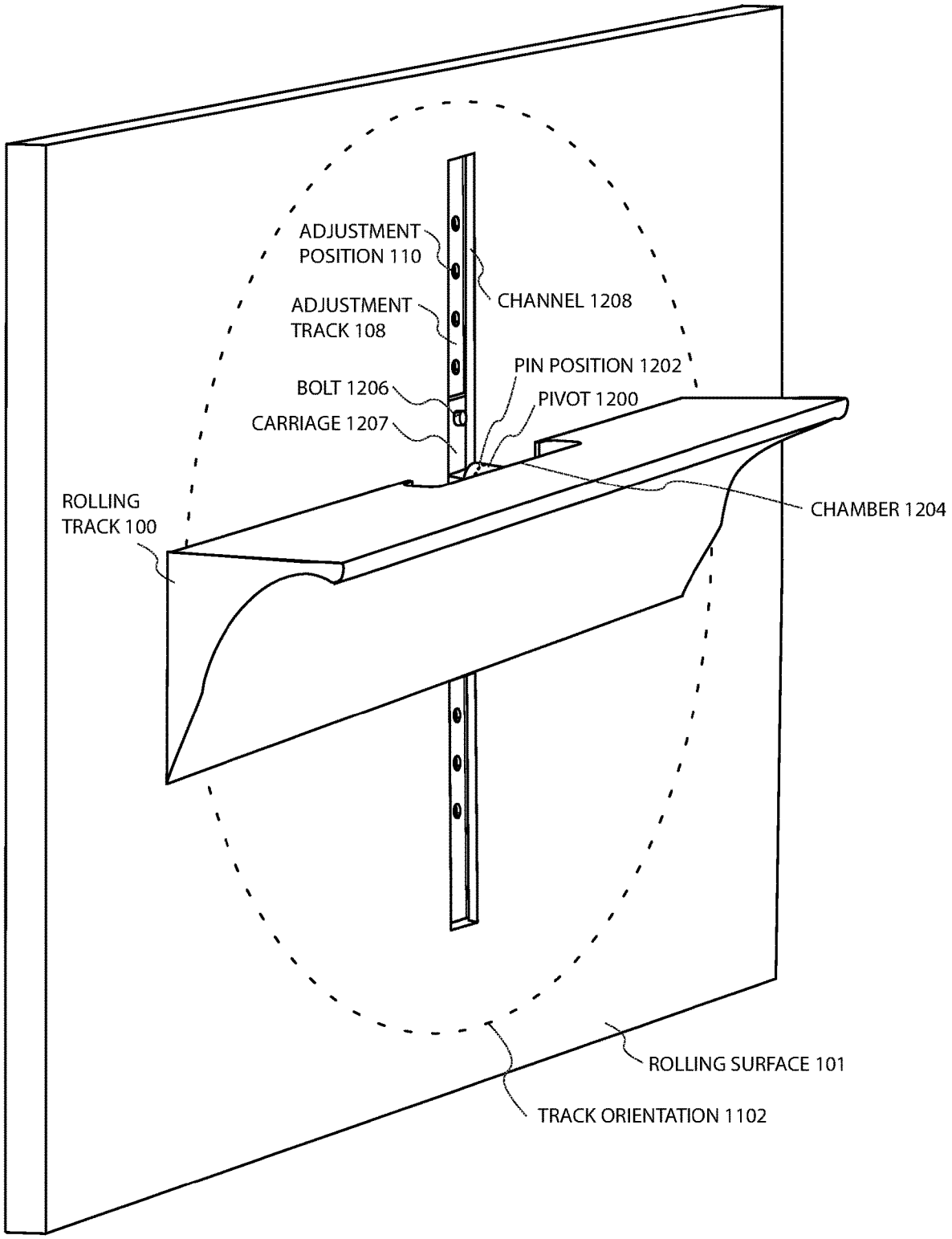
FIG. 12 illustrates an instance of the rolling track comprising a pivot on which the rolling track can rotate and a carriage on which the rolling track can linearly slide in a channel to implement the adjustment track, the carriage and the pivot enabling multiple track orientations and positions from which the user can generate myofascial release pressure, according to one or more embodiments.

FIG. 12 illustrates an instance of the rolling track 100 comprising a pivot 1200 on which the rolling track 100 can rotate and a carriage 1207 on which the rolling track 100 can linearly slide in a channel 1208 to implement the adjustment track 108, the carriage 1207 and the pivot 1200 enabling multiple orientations (e.g., track orientations 1102) and positions from which to generate the myofascial release pressure 107 for the user, according to one or more embodiments. In the embodiment of FIG. 12, a chamber 1204 within the rolling track 100 provides a space to accommodate the pivot 1200 without interfering with the transition of the support contour 104 to the rolling surface 101. The pivot 1200 allows the rolling track 100 to rotate to achieve two or more track orientations 1102 and lock into place via a pivot lock (e.g., the pivot lock 1315 of FIG. 13) such that the rolling track 100 is immobilized relative to the rolling surface 101. The pivot 1200 may, for example, be based on a hinge, two coaxial tubes that can rotate relative to one another (including the use of ball bearings), an axle, or other rotational devices. In one or more embodiments, the pivot 1200 permits the rolling track to rotate 360 degrees, including to arrive in a concave-up position on an instance of the rolling surface 101 in a vertical position. In the embodiment of FIG. 12, the pivot 1200 utilizes a pin (e.g., the pin 1310, further shown and described in FIG. 13) as a part of a locking mechanism of the pivot lock 1315 to fix a track orientation 1102, with multiple pin positions 1202 defining lockable track orientations 1102, as shown and described in conjunction with FIG. 13. The rolling track 100 may also slide along the adjustment track 108 to two or more adjustment positions 110, with a bolt 1206 screwing in or otherwise fixing the carriage 1207 in the adjustment position 110.

Figure 13:
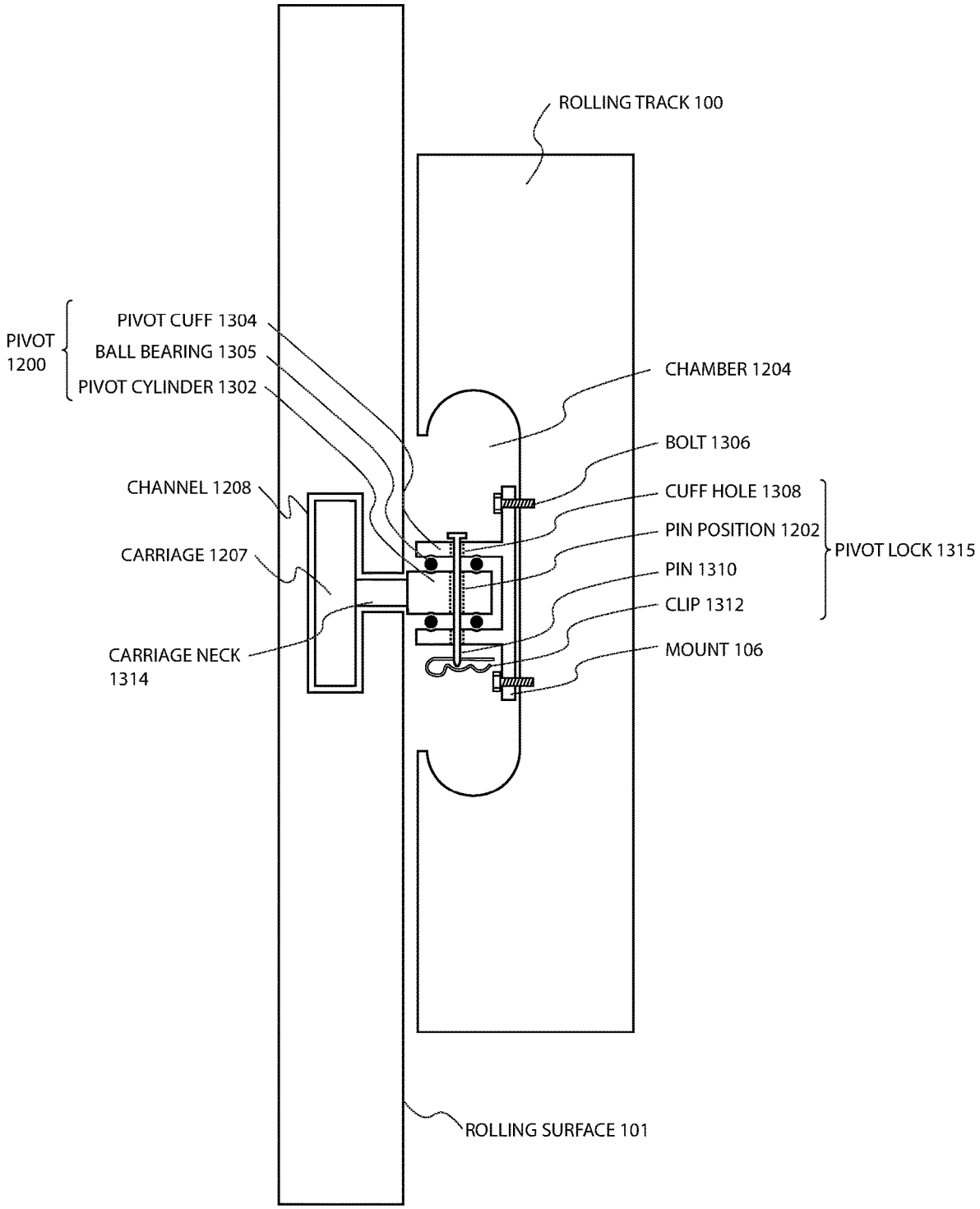
FIG. 13 is a cross-sectional view of the rolling track of FIG. 12 comprising a chamber of the rolling track for housing the pivot, ball bearings of the pivot to enable rotational motion, a pin position for fixing the pivot in a track orientation, and a pin and a clip for securing the pivot in a track orientation, according to one or more embodiments.

FIG. 13 is a cross-sectional view of the rolling track 100 of FIG. 12 comprising the chamber 1204 of the rolling track 100 for housing the pivot 1200, ball bearings 1305 of the pivot 1200 to enable rotational motion of the pivot 1200, and a pin position 1202 in conjunction with a pin 1310 and a clip 1312 for securing the pivot 1200 in a specific instance of the rolling track orientation 1102, according to one or more embodiments. In the embodiment of FIG. 13, the pivot 1200 is implemented with ball 103. Bearings 1305, which may be a low-friction means of rotational motion for adjusting the rolling track 100. The pivot 1200 may be comprised of a pivot cylinder 1302 set into a pivot cuff 1304. A set of ball bearings 1305 may provide an interface between the pivot cylinder 1302 and the pivot cuff 1304. The pivot cylinder 1302 may have two or more pin positions 1202 that in permissible orientations line up with two or more cuff holes 1308, permitting a pin 1310 to slide through an assembly of the pivot 1200, resulting in a locked track orientation 1102. The pin 1310 may have a hole at one end to accommodate a pin 1310 that may ensure the pin 1310 stays in place. The chamber 1204 may be large enough to accommodate the removal and replacement of the pin 1310. In the specific cross-sectional view of FIG. 13, and for an instance of the rolling surface 101 in a vertical position, the pin position 1202 fixes the rolling track 100 horizontally in either a concave-up or concave-down position.

Further in the embodiment of FIG. 13, the carriage 1207 is show within the channel 1208. The carriage 1207 is connected to the pivot cylinder 1302 via the carriage neck 1314. The carriage 1207, the carriage neck 1314, and the pivot cylinder 1302 may be separate components that form an assembly or may be integrated. The carriage 1207 may linearly slide along the channel 1208 through a variety of mechanisms or methods. For example the carriage 1207 may also utilize ball bearings, may be in direct contact with the channel 1208 (e.g., with a lubricant such as grease reducing a friction), or may use another method to accommodate linear motion as may be known in the art. Also in the embodiment of FIG. 13, the pivot cylinder 1302 may be attached or integrated with the carriage 1207, and the pivot cuff 1304 may be integrated with the mount 106 (e.g., a mounting plate) fastening the pivot 1200 to the rolling track 100.

In the embodiment of FIG. 13, the pivot 1200 is comprised of the pivot cylinder 1302, the ball bearings 1305, and the pivot cuff 1304. The pivot lock 1315 is comprised of the cuff hole 1318, the set of two or more pin positions 1202, the pin 1310, and the clip 1312. Methods of implementing the pivot lock 1315 may be utilized, including with different instances of the pivot 1200 (e.g., based on coaxial sliding tubes) as may be known in the art.

In the embodiments of FIG. 12 and FIG. 13, the pivot 1200, the carriage 1207, and other aspects may not be shown to scale. An appropriate robustness of the components should be selected to secure the rolling track 100 remains relatively static while the force 105 is applied by the user (such that effective opposed myofascial release pressure 107 can be produced), including at either end of the rolling track 100 which may substantially increase leverage on the pivot 1200. In the embodiment of FIG. 12, the channel 1208 exposed beneath the rolling track 100 in a given adjustment position 110 may interfere with free-rolling of the ball 103 if the channel 1208 is too wide. In one or more embodiments, the carriage neck 1314 may be relatively narrow (e.g., one-quarter inch, one-half inch) to reduce the size of the channel 1208 exposed to the rolling ball 103 such as to reduce the ball 103 from catching or snagging during use. Although not shown, additional mechanisms or methods may be used such as a rigid sheet that a use may place on the rolling surface 101 over an exposed portion of the channel 1208 below the rolling track 100. In one or more embodiments not shown, the pivot 1200 of FIG. 12 may be integrated with one of the adjustment tracks of FIG. 10A, FIG. 10B, and/or FIG. 10C, such that no channel 1208 is required and the rolling surface 101 below the rolling track 100 may remain clear of any potential obstruction to rolling of the ball 103.

Figure 14:
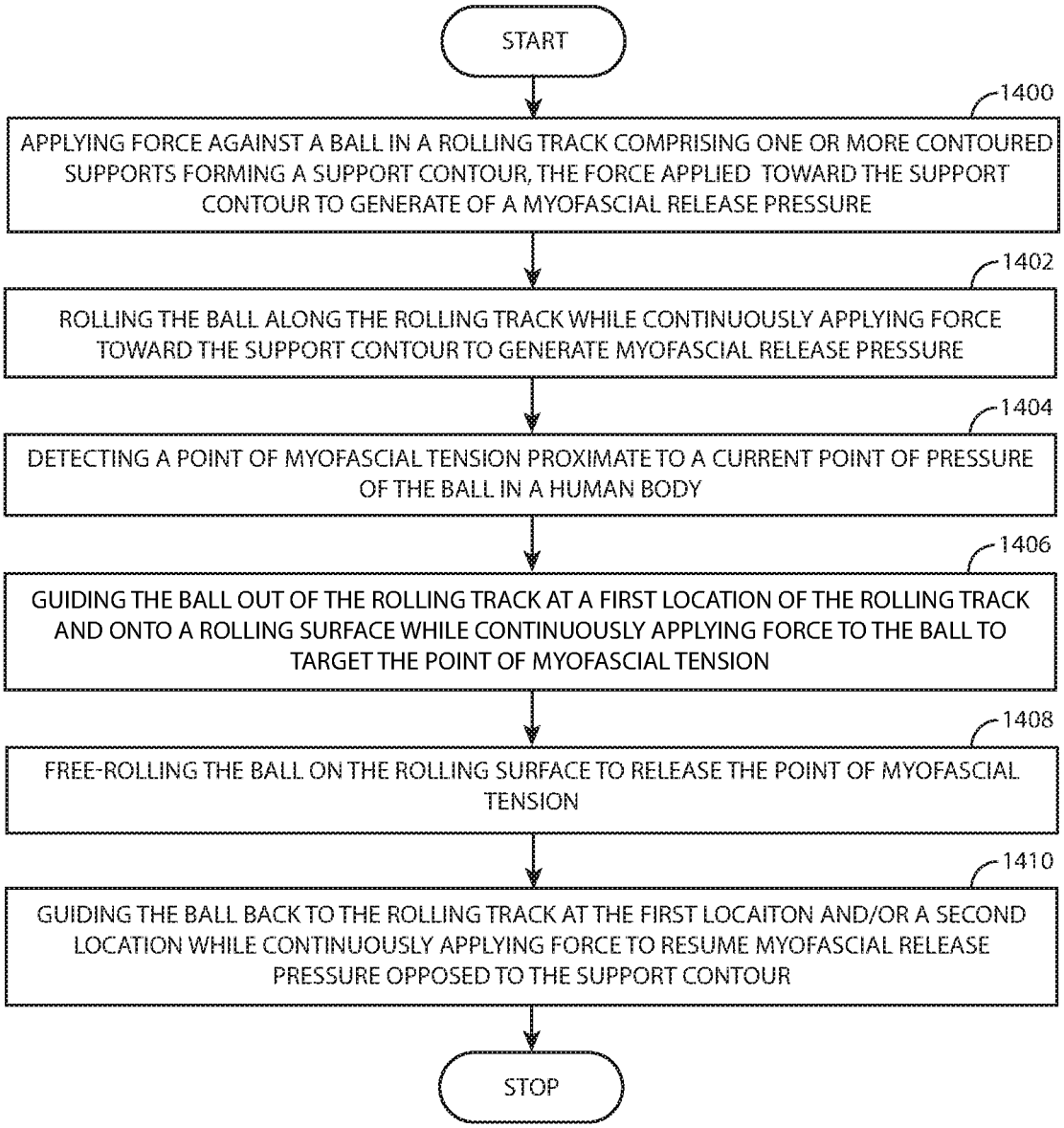
FIG. 14 is a targeted release process flow illustrating a process by which the rolling track may be used to generate myofascial release pressure and release one or more points of myofascial tension of the human body, according to one or more embodiments.

FIG. 14 is a targeted release process flow 1450 illustrating a process by which the rolling track 100 may be used to generate myofascial release pressure 107 and release one or more points of myofascial tension of the human body, according to one or more embodiments. In operation 1400 the user applies a force (e.g., the force 105 of FIG. 2) against a ball (e.g., the ball 103) in a rolling track 100 comprising one or more contoured supports 102 forming a support contour 104, the force 105 applied toward the support contour 104 to generate the myofascial release pressure 107. The user may apply as much force 105 as required to generate a myofascial release pressure 107 that is firm but not painful. The rolling track 100 may be positioned on a horizontal rolling surface 101, a vertical rolling surface 101, or an oblique rolling surface 101. The ball 103 may be selected to be within a shore A hardness of 20 to 80 durometers, and in one or more preferred embodiments a Shore A hardness of 20 to 35 durometers.

In operation 1402 the user rolls the ball along the rolling track 100 while continuously applying force 105 toward the support contour 104, permitting generation of myofascial release pressure 107 (e.g., in a travel path 109 that may travel along a body part, such as the bottom of the foot, the top of a bicep, along a hip, or over a shoulder blade). The user may continue operation 1402, rolling the ball 103 back and forth in the rolling track 100 while held in the support contour 104 with continuous force 105, including change an angle of force 105 within the force range 207 of FIG. 2. In operation 1404, the user detects a point of myofascial tension proximate to a current point of pressure of the ball 103 (e.g., the myofascial release pressure 107 opposed to the force 105 toward a point 204 on the support contour 104. Points of tension may often occur in diverse areas, and may be sensed through "referred pain" where pain in one part of muscles can be traced to a tension point in a muscle that may or may not be proximate to the pain.

In operation 1406 the user guides the ball 103 out of the rolling track 100 at a first location of the rolling track 100 (e.g., the location 111A of FIG. 1) and onto a rolling surface 101 while continuously applying the force 105 to the ball 103 to target the point of myofascial tension sensed in operation 1404. The support contour 104 of the rolling track 100 transitions to the rolling surface 101 such that the ball 103 may be guided substantially unimpeded (without catching or halting while the continuous force 105 is applied by the user). A transition of the support contour 104 is shown at various angles in the present embodiments, ranging from a curving surface with a curved drop off as in FIG. 1, a substantially continuous curve fading into the rolling surface 101 as shown in FIG. 2, or an arc 604 giving way to a strait ramp as shown in FIG. 12.

In operation 1408 the user free-rolls the ball 103 on the rolling surface 101 to release the point of myofascial tension, e.g., with the myofascial release pressure 107 generated opposed to the force 105 applied against one or more points 204 on the rolling surface 101. The combination of the rolling track 100 and the rolling surface 101 may therefore combine the available force ranges 205 of the support contour 104 along with a free-rolling surface permitting exploration and tension point sensing. In one or more embodiments, the combination of rolling in the rolling track 100 and free-rolling on the rolling surface 101 may permit a single myofascial release apparatus and/or method for many muscles of the human body, including groups of muscles. The particular application and utility of the rolling track 100 to the neck, shoulders, and upper back is further described in conjunction with the process flow 1550 of FIG. 15.

In operation 1410 the user guides the ball 103 back to the rolling track 100 while continuously applying force 105 to resume the myofascial release pressure 107 opposed to the support contour 104 (e.g., a point 204 on the support contour 104). The user may repeat operations 1400 through 1410 until the user makes progress and/or fully resolves myofascial tensions points, including changing ball sizes, changing ball hardness, changing the rolling track orientation 1102 or adjustment position 110, or changing an instance of the rolling track 100 (e.g., each with different instances of the support contour 104 to accommodate different sizes or otherwise to change a rolling profile of one or more instances of the ball 103).

Figure 15:
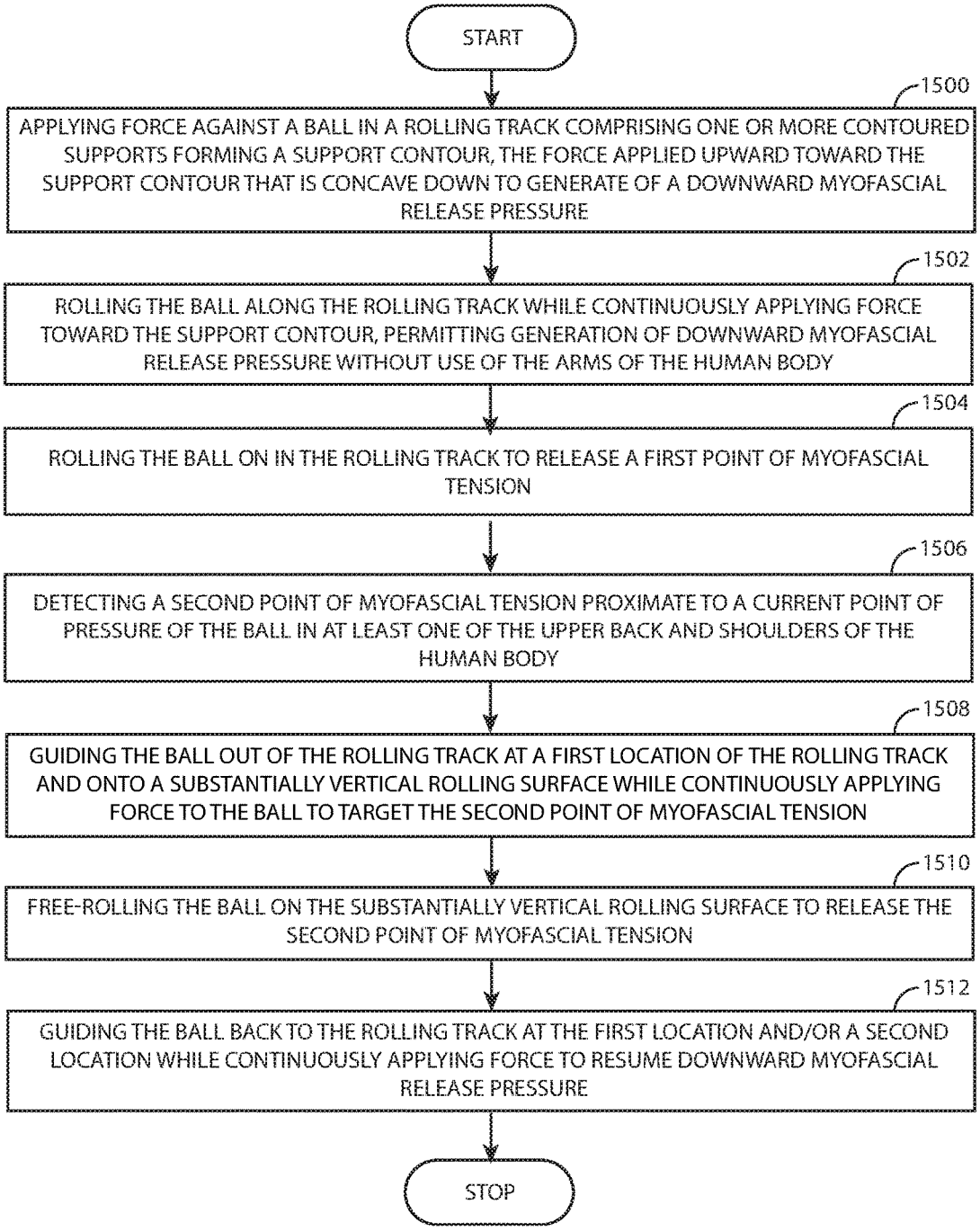
FIG. 15 is a down-pressure targeted release process flow illustrating a process by which the rolling track may be used to generate down-pressure on the neck, upper back, and shoulders, and without substantially utilizing arm muscles, to find, target, and resolve one or more points of myofascial tension, according to one or more embodiments.

FIG. 15 is a down-pressure targeted release process flow 1550 illustrating a process by which the rolling track 100 may be used to generate down-pressure on the neck, upper back, and shoulders, including without use of the arms, to find and resolve one or more points of myofascial tension, according to one or more embodiments. Process flow 1550 is primarily utilized for an instance of the rolling track 100 in a concave-down position fixed relative to a rolling surface 101 that is substantial vertical. The substantially vertical rolling surface 101 permits a user to stand on a horizontal surface. In one or more embodiments, the rolling surface 101 may be fifteen degrees in either direction out of a vertical position. In one or more embodiments, the rolling surface 101 may be five degrees in either direction out of a vertical position.

In operation 1500 the user applies a force 105 against a ball 103 in a rolling track 100 comprising one or more contoured supports 102 forming a support contour 104 that is concave down, the force 105 applied upward toward the support contour to generate of a downward myofascial release pressure 107. For example, where the embodiment of FIG. 2 is mounted on a vertical rolling surface 101, the force 105B may be applied upward, against gravity, to generate the myofascial release pressure 107B in a downward direction. The use of the rolling track 100 to generate the downward myofascial release pressure 107 may permit the user, standing or sitting on a horizontal surface, to primarily utilize the lower body in generating the upward force 105 and control each instance of the travel path 109 chosen by the user. As a result, the arms may remain relaxed, increasing a likelihood that the shoulders, neck, and upper back will also remain relaxed. Use of the arms to generate myofascial release pressure on the neck, shoulders, and upper back may otherwise engage all of these muscles and as a result increase resistance of the muscles and lower effectiveness of the myofascial release pressure. In operation 1502 the user rolls the ball 103 along the rolling track 100 while continuously applying force 105 toward the support contour 104 (e.g., various points 204 on the support contour 104), permitting generation of downward myofascial release pressure 107 without use of the arms of the human body. In operation 1404 the user rolls the back on the rolling track 100 to release a first point of myofascial tension, for example in a location that may be difficult to ordinarily work out the tension through self-massage or generate strong down-pressure, such as on top of the user's shoulder. In operation 1506, similar to operation 1404, the user detects a point of myofascial tension proximate to a current point of pressure (e.g., the myofascial release pressure 107) in the upper back and/or shoulders. In operation 1518, the user guides the ball 103 out of the rolling track 100 at a first location 111A of the rolling track 100 and onto a substantially vertical instance of the rolling surface 101 while continuously applying force 105 to the ball 103, to target the point of myofascial tension.

In operation 1510, the user free-rolls the ball 103 on the substantially vertical rolling surface 101 to release the point of myofascial tension, similar to operation 1408. Similar to operation 1500 and 1502, operation 1510 may be conducted without use of the arms, continuing relaxation of the upper back muscles. In operation 1512 the user guides the ball 103 back to the rolling track 100 while continuously applying force 105 to resume downward myofascial release pressure 107.

Figure 16:
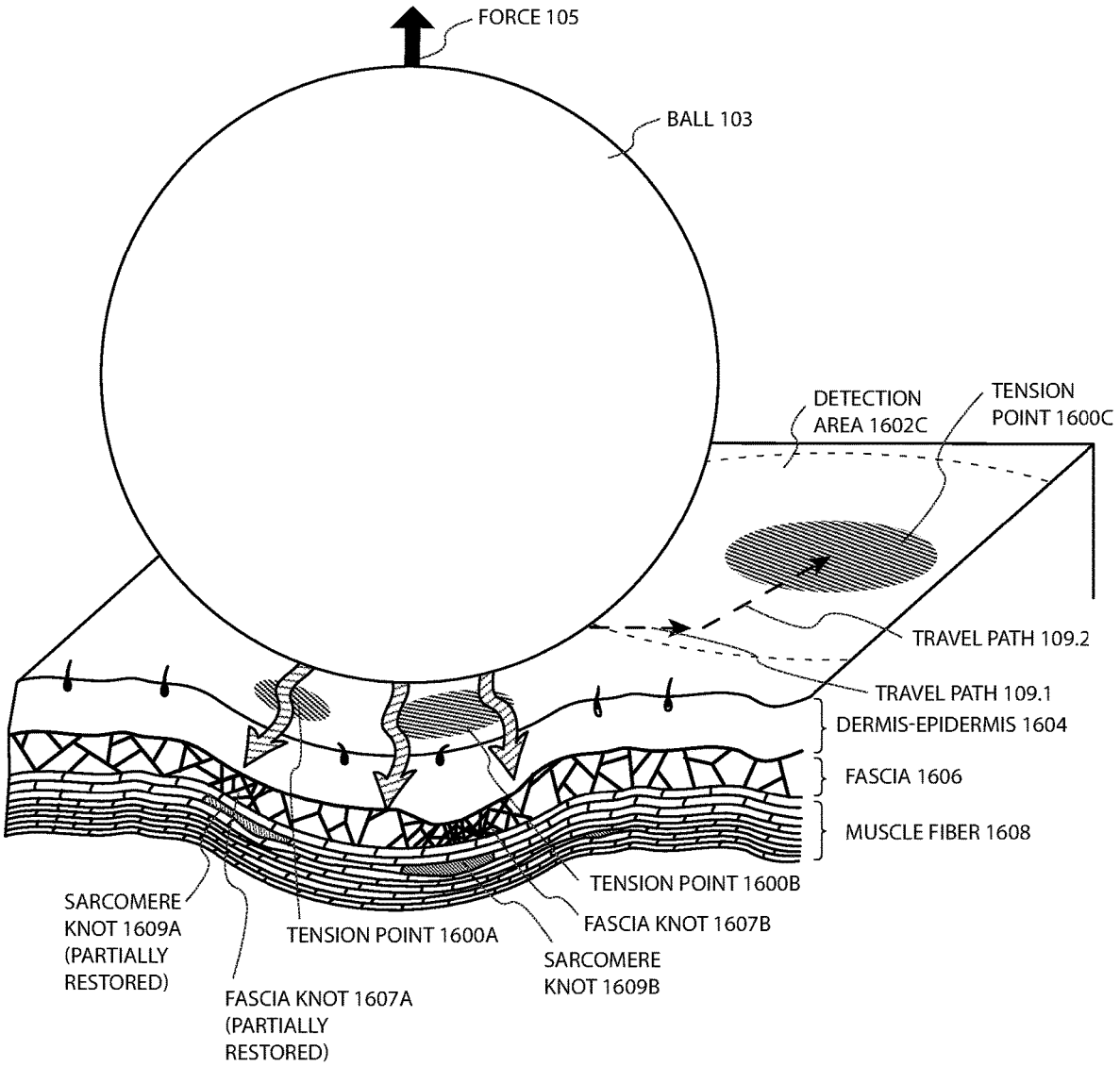
FIG. 16 illustrates resolution and targeting of tension points associated with fascia knots of a fascia and/or sarcomere knots of a muscle fiber, including how the ball in the rolling track and/or on the rolling surface applies myofascial release pressure to tension points along a first travel path over the epidermis of the user, and further illustrates the user's diversion of the ball to target and resolve sensed tension points to bring complete relief to the user, according to one or more embodiments.

FIG. 16 illustrates resolution and targeting of tension points 1600 associated with fascia knots 1607 of a fascia 1606 and/or sarcomere knots 1609 of a muscle fiber 1608, including how the ball 103 in the rolling track 100 and/or on the rolling surface 101 applies myofascial release pressure 107 to tension points 1600 along a first travel path over the epidermis 1604 of the user, and further illustrates the user's diversion of the ball 103 to target and resolve a sensed tension point 1600C (e.g., sensed within the detection area 1602C) to bring complete relief to the user, according to one or more embodiments. FIG. 16 represents an example of a process by which the ball 103 and the rolling track 100 resolve tension points, according to one or more embodiments. A cross-section of the human body is illustrated, a first layer being the dermis-epidermis 1604, followed by the fascia 1606 providing a web and/or network of connective tissue connecting the dermis-epidermis 1604 to the muscle fiber 1608. The muscle fiber 1608 is comprised of a plurality of sarcomeres organized into a bundle. Although not shown, a level deeper may exist another layer of fascia, followed by another muscle fiber. Such a second layer of fascia (and successive layers thereafter) may provide connective tissue to a next bundle of the muscle fibers.

Injury, trauma, vigorous exercise, or prolonged low-tension load (e.g., "poor" posture such as craning a neck forward toward a laptop computer or smartphone) may bring about both fascia knots 1607 in which the fascia 1606 gets tangled or knotted and/or may bring about sarcomere knots 1609. The myofascial knots 1607 and/or sarcomere knots 1609 may create felt tension points 1600, which may be small (e.g., fractions of an inch in diameter) or may cover larger portions of muscle (e.g., an inch or more in diameter). The result may be construction of the muscle fiber 1608, lowering flexibility, inflammation and pain. Further, the sarcomere knots 1609 may inhibit oxygen and other nutrients from entering muscle cells within the constructed area, which may release distress and inflammatory signal molecules.

Myofascial release pressure, for example from message and kneading with the ball 103, may unwind the myofascial knots 1607 and/or sarcomere knots 1609. As illustrated in FIG. 16, the ball 103 in moving over tension point 1600A (possibly repeatedly and/or with myofascial release pressure 107 applied at several angles) partially resolved the fascia knot 1607A and an associated sarcomere knot 1609A. Following restoration, the associated tension point 1600A may recover, and the area may recover range of motion, receive increased nutrients to cells, restore flexibility and connective function of the fascia 1606, and/or lower inflammation. Additional physiological effects and associated benefits from the myofascial release pressure 107, not shown but as may be known to result from message, may also occur to improve healing.

To generate effective myofascial release pressure 107 to effect resolution of the tension point 1600, it may be desirable to have a variety of directions in which the force 105 can be applied to the ball 103 by the user. A ball, for example an instance of the ball 103 with shore A hardness between 20 and 35, may have increased effectiveness because the surface depression (e.g., the surface depression 206 of FIG. 2) against the dermis-epidermis 1604 may distribute the myofascial release pressure 107 is applied to a broader area and/or an entire tension point 1600 simultaneously. This may result in a kneading motion which may be known in the art of massage and physical therapy to effectively resolve tension points 1600. In contrast, a hard ball may in some circumstances cause a muscle to resist the myofascial release pressure 107 by tensing up.

Effective release of tension points 1600, including fascia knots 1607 and/or sarcomere knots 1609, may also involve "hunting" for the tension points 1600, the location of which may not be easy for the user to determine due to the three-dimensional structure of muscles and/or the phenomenon of referred pain. Therefore, effective myofascial release is partially enabled not only by a variety of angles on which myofascial release pressure 107 can be applied, but by being able to search for tension points 1600. For example, in the embodiment of FIG. 16 the ball 103 may be traveling along a first path 109.1 (e.g., while in the rolling track 100) to resolve the first tension point 1600A and a second tension point 1600B. However, when the ball 103 moves within a detection area 1602C, the user may feel a tension point 1600C. The user may then divert the ball 103 along travel path 109.2 to find the tension point 1600C. Although the path 109.2 is shown as strait line for clarity, the user may roll in several directions before finding and targeting the tension point 1600C. For example, the travel path 109.2 occur where the user guides the ball 103 out of the rolling track 100 and on to the rolling surface 101. If the tension point 1600C is successfully found by free-rolling on the rolling surface 101, the user may also reposition the ball 103 into the rolling track 100 to use the support contour 104 to generate several angles of myofascial release pressure 107 against the tension point 1600C and/or adjust the rolling track to a different adjustment position 110 or track orientation 1102.

Figure 17:
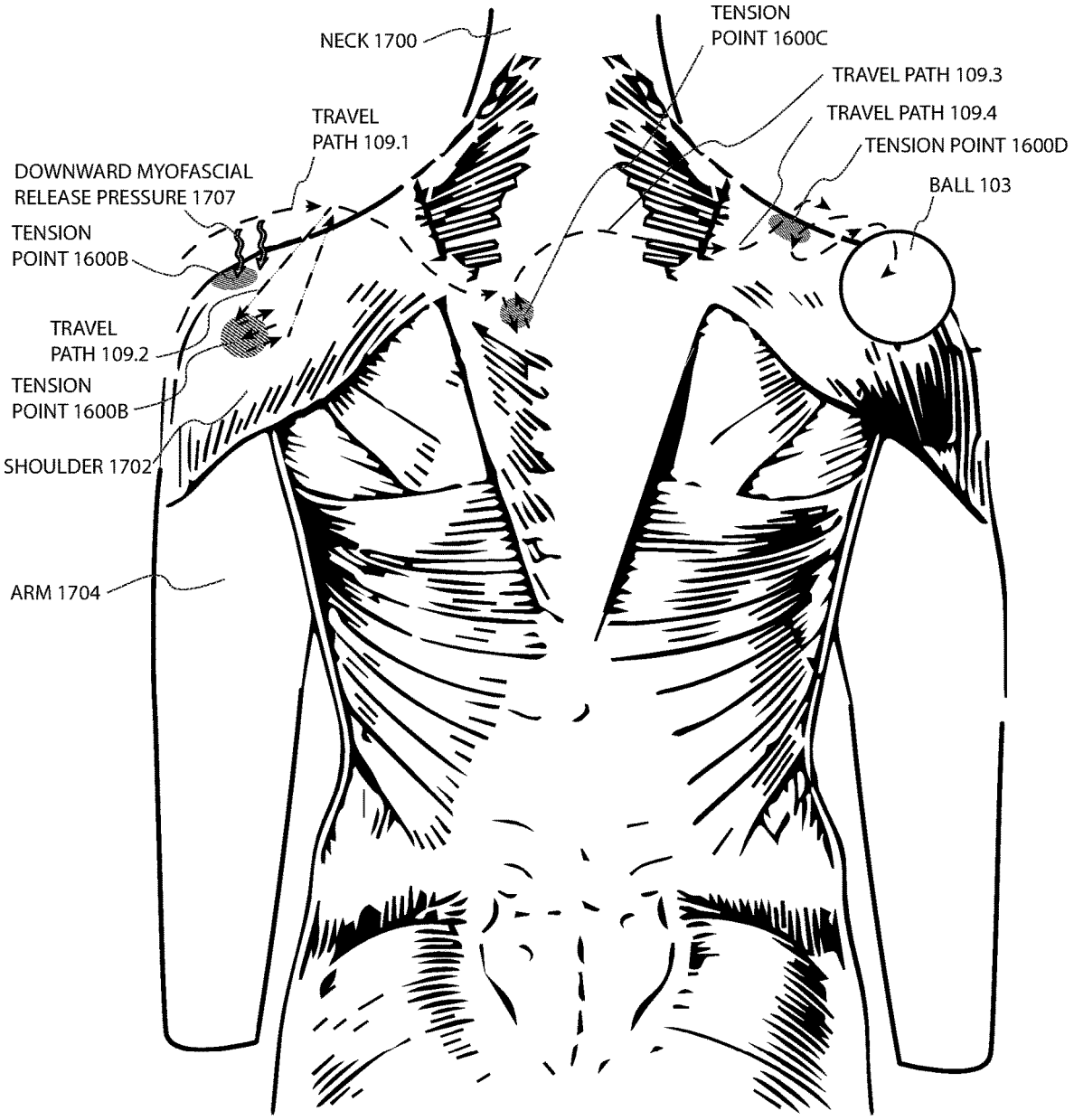
FIG. 17 illustrates restoration of a user's fascia and muscles through use of the rolling track (e.g., the rolling track of FIG. 1, FIG. 8, FIG. 9) by generating down-pressure (e.g., by the process flow of FIG. 15) to release multiple tension points in the shoulders, back, and neck, including permitting the ball to leave the rolling track for the rolling surface to "hunt" for additional tension points sensed during generation of downward pressure, according to one or more embodiments.

FIG. 17 illustrates restoration of a user's fascia and muscles through use of the rolling track 100 (e.g., the rolling track 100 of FIG. 1, FIG. 8, FIG. 9) by generating down-pressure (e.g., by the process flow 1550 of FIG. 15) to release multiple tension points (e.g., the tension points 1600 of FIG. 16) in the shoulders, back, and neck, including permitting the ball 103 to leave the rolling track 100 to the rolling surface 101 to "hunt" for additional tension points sensed during generation of downward pressure, according to one or more embodiments. In the embodiment of FIG. 17, the user places the ball 103 in the rolling track 100 and begins to generate a downward myofascial release pressure 1707 directly down on the top of the shoulder blade (e.g., a top of the shoulder 1702) along travel path 109.1, which may ordinarily be a difficult location to self-massage, especially without engaging the arms (e.g., the arm 1704 is shown relaxed). Following resolution of tension point 1600A, the user may sense a tension point 1600B in a lower shoulder blade (e.g., through referred pain or through a detection area 1602B, not shown in the embodiment of FIG. 17). The user may guide the ball 103 out of the support contour 104 of the rolling track 100 along travel path 109.2. Several back-and-forth motions of rolling surface may resolve the tension point. (If the tension point is difficult, the user may reposition the ball 103 in the rolling track 100 and reposition themselves relative to the rolling track 100 (and/or adjust its height) to utilize the support 102 and its support contour 104 to apply a variety of directions of myofascial release pressure 107.) Next, the user may return the ball 103 to the rolling track 100 to generate the downward myofascial release pressure 1707.

The user may continue moving the ball 103 in the rolling track 100 along travel path 109.3. The rolling track 100 may in one or more embodiments be a substantially linear track, the path 109.3 is shown as several curves, for example, due to the user changing their position while still keeping the ball 103 in the rolling track 100 with continuous force 105. Thus, tension point 1600C may be resolved with only the aid of the support contour 104 rather than in conjunction with the rolling surface 101. Finally, the ball 103 may be guided along travel path 109.4 to the opposite shoulder where the user may determine that a tension point 1600D exists on a front of the shoulder. The user may rotate to face the rolling track 100 to generate the downward myofascial release pressure 1707.

As a result, the user may have relaxation, released muscle and fascia tension, increased circulation, increased range of motion, better performance, and decreased pain. In the embodiment of FIG. 17, the user may be able to achieve substantial relief without needing to sit, get down on the ground, or over-engage muscles proximate to locations of the tension points that could have prolonged or inhibited treatment (e.g., the arms).

A specific example will now be described. Lauren is a director of business development at an enterprise company. She spends long hours at work, but her hobbies including running and gardening. Lauren's job requires her use a smartphone to check her email at all times of the day, and she often spends 8 or more hours per day on her laptop computer, including during her morning commute or a train. Lauren tries to have good posture but often holds her head too far forward while working on her phone and computer, which tenses her neck muscles and has resulting in several severe headaches.

On weekends, Lauren often trains for marathons. She also takes pride in her garden, which often involves digging holes with a shovel and lifting heavy potted plants and bags of fertilizer. Her muscles get very sore from both of these activities, sometimes to the point where she has difficulty walking. From her combination of long work hours and recreational activities Lauren regularly develops tension points from fascia knots that develop in her fascia connective tissue.

Lauren tries to get massages, but a professional massage can be expensive and hard to schedule. It is also sometimes difficult to communicate where her tension points are to the masseuse. Often, knots and tension points develop unexpectedly.

Lauren has tried several methods of self-massage. For example, she sometimes rolls with a tennis ball against a wall. However, Lauren finds it difficult to generate the angles of pressure she needs, especially downward pressure that would held per back, shoulders, and neck. Lauren has also purchased numerous massage rollers. Sometimes the rollers feel good, but they only roll in one direction so in general Lauren finds she can only generate two directions of pressure with the rollers. Several of her rollers also require that she get down on the floor. Lauren also purchased a hook-shaped pole that she can hold to try to massage her own back. However, because it requires use of her arms it tenses nearby connected back muscles—the very muscles in she may try to massage.

Finally, Lauren acquires an instance of the rolling track (e.g., the rolling track 100 of FIG. 1, or FIG. 8, or FIG. 9). Lauren attaches its adjustment track 108 to a wall in her home, and uses the wall as the rolling surface 101. Lauren finds she can now generate a wide variety of pressures (e.g., via the force range 207) against the support 102, while still being able to search for tension points 1600 against the wall while free-rolling, all in a single activity without the need to switch equipment. Lauren is also able to generate down-pressure and massage her back without engaging her arm muscles, which has thus far been difficult for her to do. Because Lauren acquired a version of the rolling track 100 with the adjustment track 108, she can change its height on the wall to so she can massage her hips and lower back after running, and arms after gardening. Lauren now has an effective tool for myofascial release that unwinds knots in her fascia and sarcomeres. As a result, she is experiences greater range of motion in her muscles (increasing her running performance), has less neck pain and headaches (allowing her to work more effectively), and is able to garden for longer periods.

Although the present embodiments have been described with reference to specific example embodiments, it will be evident that various modifications and changes may be made to these embodiments without departing from the broader spirit and scope of the various embodiments. In addition, the process flows depicted in the figures do not require the particular order shown, or sequential order, to achieve desirable results. In addition, other operations may be provided, or operations may be eliminated, from the described flows, and other components may be added to, or removed from, the described systems, devices, and apparatuses. Accordingly, other embodiments are within the scope of the following claims.

What is claimed is:

1. An apparatus for targeted myofascial release of a human body, the apparatus comprising:

a rolling track comprising one or more supports forming a support contour, the one or more supports permitting a ball to roll along the rolling track while the human body exerts force against the ball toward the support contour, the rolling track open along an edge such that the human body can contact the ball, the support contour transitioning into a rolling surface such that while continuous force is exerted against the ball the human body can guide the ball out of the rolling track to the rolling surface substantially unimpeded at a first location along the rolling track and rejoin the rolling track from the rolling surface substantially unimpeded at a second location along the rolling track, and a mount for securing the rolling track relative to the rolling surface such that the rolling track is immobile relative to the rolling surface when the force is exerted by the human body against the ball toward the support contour.

2. The apparatus of claim 1, further comprising a lip of the rolling track that retains the ball in the rolling track when a force that is both parallel to the rolling surface and toward the support contour is exerted on the ball by the human body.

3. The apparatus of claim 2, further comprising:

an adjustment track connected to the rolling track, the adjustment track providing two or more adjustment positions such that the rolling track is repositionable along the rolling surface.

4. The apparatus of claim 3, wherein the friction means retaining the ball between 2 inches in diameter and 4 inches in diameter in the rolling track while the force exerted by the human body toward the support contour is parallel to the rolling surface.

5. The apparatus of claim 1, further comprising:

wherein at a cross-section of the rolling track an intersection of a first line normal to a first point on the support contour and a second line normal to a second point on the support contour form between a ninety-degree angle and a one-hundred-and-eighty-degree angle, inclusive.

6. The apparatus of claim 5, wherein the support contour comprises an arc that is between a quarter-circle and a semi-circle, inclusive.

7. The apparatus of claim 6, further comprising:

wherein the one or more supports comprises one or more rails, and wherein the one or more rails are spaced such that an instance of the ball fitted to the arc having a Shore A hardness of 20 to a Shore A hardness of 35 rolls substantially unimpeded while continuous force is exerted against the ball toward the support contour by the human body.

8. The apparatus of claim 7, further comprising:

a cord coupled to the rolling track for attachment to the ball, the cord permitting the instance of the ball fitted to the arc to roll substantially unimpeded along the rolling track as the cord rolls between the ball and the one or more supports.

9. An apparatus for targeted myofascial release of an upper back and shoulders of a human body, the apparatus comprising:

a rolling surface that is substantially vertical to permit motion of a ball in any direction while a human body exerts force against the ball toward the rolling surface for generation of a myofascial release pressure, and a rolling track comprising one or more supports forming a support contour, the rolling track immovably fixable on the rolling surface, the one or more supports permitting the ball to roll along the rolling track while a human body exerts force against the ball toward a point on the support contour, the rolling track open along an edge such that the human body can contact the ball and guide the ball out of the rolling track for a rolling surface substantially unimpeded at a first location along the rolling track and rejoin the rolling track from the rolling surface substantially unimpeded at a second location along the rolling track, the support contour facing concave down on the rolling surface permitting the ball to be held against gravity and for generating the myofascial release pressure downward against the upper back and shoulders of the human body.

10. The apparatus of claim 9, wherein at a cross-section of the rolling track and the rolling surface perpendicular to the rolling track an intersection of a first line normal to a point on the support contour and a second line normal to a point on the rolling surface form between a ninety-degree angle and a one-hundred-and-eighty-degree angle, inclusive.

11. The apparatus of claim 10, wherein the support contour comprises an arc that is between a quarter-circle and a semi-circle, inclusive.

12. The apparatus of claim 9, further comprising:

a friction surface of the rolling track that retains the ball in the rolling track when a force that is both parallel to the rolling surface and toward the support contour is exerted on the ball by the human body.

13. The apparatus of claim 9, further comprising:

an adjustment track providing two or more adjustment positions to immovable fix the rolling track along the rolling surface that is substantially vertical for adjustment to a height of the human body.

14. The apparatus of claim 9, further comprising:

a mount comprising one or more pegs protruding from the rolling track to immovably fix the rolling track relative to the rolling surface, wherein the rolling surface comprises a plurality of inlets to receive the one or more pegs of the rolling track to immovably fix the rolling track along the rolling surface.

15. The apparatus of claim 11, further comprising:

wherein the arc is fitted to an instance of the ball that is between a 2 inch diameter and a 3.5 inch diameter.

16. The apparatus of claim 15, further comprising:

a pivot connected to the rolling track allowing the rolling track to adjustably rotate, and a pivot lock in coordination with the pivot to lock the rolling track in a track orientation after adjustably rotating.

17. The apparatus of claim 11, wherein the one or more supports is a contoured surface that is substantially smooth.

18. An apparatus for targeted myofascial release of an upper back and shoulders of a human body, the apparatus comprising:

a ball comprising a connection point, the ball for providing a myofascial release pressure when force is applied against the ball by the human body, a cord attached to a connecting point of the ball;

a rolling surface that is substantially vertical to permit motion of the ball in any direction while the human body exerts force against the ball toward the rolling surface, a rolling track comprising one or more supports forming a support contour, the rolling track immovably fixable relative to the rolling surface, the one or more supports permitting the ball to roll along the rolling track while the human body exerts force against the ball toward the support contour, the rolling track forming an opening along an edge such that the human body can contact the ball and guide the ball out of the rolling track to the rolling surface substantially unimpeded at a first location along the rolling track and rejoin the rolling track from the rolling surface substantially unimpeded at a second location along the rolling track, the support contour facing concave down on the rolling surface permitting the ball to be held against gravity and for generating the myofascial release pressure downward against the upper back and shoulders of the human body, wherein the ball and the cord permitting the ball to roll substantially unimpeded along the rolling track when the cord rolls between the ball and the one or more supports and roll substantially unimpeded along the rolling surface when the cord rolls between the ball and the rolling surface.

19. The apparatus of claim 18, wherein the support contour comprises an arc that is between a quarter-circle and a semi-circle, inclusive, wherein the ball is fitted to the arc, and wherein the ball having a Shore A hardness of 20 to a Shore A hardness of 80.

20. The apparatus of claim 19, further comprising:

an adjustment track providing two or more adjustment positions to immovable fix the rolling track along the rolling surface that is substantially vertical for adjustment to a height of the human body, a pivot connected to the rolling track allowing the rolling track to adjustably rotate, and a pivot lock in coordination with the pivot to lock the rolling track in a track orientation after adjustably rotating.

* * * * *